US010513121B2

(12) United States Patent
Sakamoto

(10) Patent No.: US 10,513,121 B2
(45) Date of Patent: Dec. 24, 2019

(54) LIQUID EJECTING APPARATUS, FLUSHING ADJUSTING METHOD, CONTROL PROGRAM OF LIQUID EJECTING APPARATUS, AND RECORDING MEDIUM

(71) Applicant: SEIKO EPSON CORPORATION, Tokyo (JP)

(72) Inventor: Ryota Sakamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/703,181

(22) Filed: Sep. 13, 2017

(65) Prior Publication Data

US 2018/0086081 A1 Mar. 29, 2018

(30) Foreign Application Priority Data

Sep. 26, 2016 (JP) ..... 2016-187577

(51) Int. Cl.

| | |
|---|---|
| ***B41J 2/16*** | (2006.01) |
| ***B41J 2/165*** | (2006.01) |
| ***B41J 2/14*** | (2006.01) |
| *B41J 2/17* | (2006.01) |

(52) U.S. Cl.

CPC ..... *B41J 2/16523* (2013.01); *B41J 2/14201* (2013.01); *B41J 2/16517* (2013.01); *B41J 2/16526* (2013.01); *B41J 2/1707* (2013.01); *B41J 2002/16573* (2013.01)

(58) Field of Classification Search

None

See application file for complete search history.

(56) References Cited

U.S. PATENT DOCUMENTS

| | | | | |
|---|---|---|---|---|
| 5,541,628 | A | 7/1996 | Chang | |
| 5,856,834 | A * | 1/1999 | Murphy, III | B41J 2/1652 347/23 |
| 6,116,715 | A * | 9/2000 | Lefebvre | B41J 2/17566 347/19 |
| 6,386,664 | B1 | 5/2002 | Hosono | |
| 6,709,091 | B1 | 3/2004 | Takahashi | |

(Continued)

FOREIGN PATENT DOCUMENTS

| | | |
|---|---|---|
| CN | 102756554 A | 10/2012 |
| EP | 1950039 | 7/2008 |

(Continued)

OTHER PUBLICATIONS

Extended European Search Report for Application No. EP17159269 dated Aug. 15, 2017 (8 pages).

(Continued)

*Primary Examiner* — Erica S Lin

(74) *Attorney, Agent, or Firm* — Workman Nydegger

(57) ABSTRACT

A liquid ejecting apparatus performs ejection in which droplets are deposited onto a medium and flushing in which droplets are not deposited onto the medium. The apparatus includes a recording head configured to eject the droplets, a presentation unit configured to present at least one condition selected from a number of times of ejecting droplets in the one flushing, a weight per one of the droplets in the flushing, and a timing of the flushing to be changeable, and a flushing controller configured to control the recording head to perform the flushing based on the condition changed via the presentation unit.

16 Claims, 21 Drawing Sheets

| PATTERN | NUMBER OF FLUSHING | VOLUME OF FLUSHING |
|---|---|---|
| 1 | 15 TIMES | 0.1 ml |
| 2 | 25 TIMES | 0.25 ml |
| 3 | 50 TIMES (STANDARD) | 0.50 ml |
| 4 | 75 TIMES | 0.75 ml |
| 5 | 100 TIMES | 100 ml |

(56) References Cited

U.S. PATENT DOCUMENTS

| | | | | |
|---|---|---|---|---|
| 6,742,859 | B2 | 6/2004 | Yonekubo | |
| 2001/0003349 | A1 | 6/2001 | Hosono | |
| 2001/0050696 | A1 | 12/2001 | Suzuki et al. | |
| 2002/0012017 | A1 | 1/2002 | Yonekubo | |
| 2002/0140752 | A1 | 10/2002 | Pulman | |
| 2003/0058302 | A1* | 3/2003 | Yonekubo | B41J 2/16526 347/35 |
| 2003/0103096 | A1 | 6/2003 | Sayama | |
| 2003/0146947 | A1 | 8/2003 | Ozaki | |
| 2004/0040614 | A1 | 3/2004 | Sesek et al. | |
| 2005/0261641 | A1* | 11/2005 | Warchol | A61F 9/0008 604/294 |
| 2005/0275682 | A1* | 12/2005 | Seshimo | B41J 2/16523 347/30 |
| 2007/0035574 | A1* | 2/2007 | Taga | B41J 2/1652 347/23 |
| 2007/0057979 | A1 | 3/2007 | Gardner et al. | |
| 2007/0176952 | A1 | 8/2007 | Sekiguchi | |
| 2009/0231372 | A1 | 9/2009 | Shibata | |
| 2009/0289976 | A1 | 11/2009 | Nishimura | |
| 2011/0242160 | A1* | 10/2011 | Tamada | B41J 2/16526 347/9 |
| 2012/0274689 | A1 | 11/2012 | Zhang | |
| 2015/0217564 | A1 | 8/2015 | Koerner | |
| 2017/0253030 | A1 | 9/2017 | Kumagai | |

FOREIGN PATENT DOCUMENTS

| | | |
|---|---|---|
| JP | 2005280199 | 10/2005 |
| JP | 2009-090533 A | 4/2009 |
| JP | 2009279816 | 12/2009 |
| JP | 2017154415 A | 9/2017 |
| JP | 2018051812 | 4/2018 |

OTHER PUBLICATIONS

U.S. Appl. No. 15/441,835, Apr. 5, 2018, Office Action.
U.S. Appl. No. 15/441,835, Oct. 4, 2017, Office Action.
Notice of Allowance issued in U.S. Appl. No. 15/909,531 dated Nov. 27, 2018.

* cited by examiner

| PATTERN | NUMBER OF FLUSHING | VOLUME OF FLUSHING |
|---|---|---|
| 1 | 15 TIMES | 0.1 ml |
| 2 | 25 TIMES | 0.25 ml |
| 3 | 50 TIMES (STANDARD) | 0.50 ml |
| 4 | 75 TIMES | 0.75 ml |
| 5 | 100 TIMES | 100 ml |

FIG. 9

216

SETTING OF NUMBER OF FLUSHING

PLEASE SELECT NUMBER OF FLUSHING.
(SETTING RANGE: 0 TO 100 TIMES)

STANDARD NUMBER OF FLUSHING: 40 TIMES
VOLUME OF FLUSHING: 0.40 ml

NUMBER OF FLUSHING ◁ 40 ▷ TIMES

VOLUME OF FLUSHING 0.40 ml

FIG. 10

216

SETTING OF VOLUME OF INK DROP OF FLUSHING

PLEASE SELECT VOLUME OF INK DROP OF FLUSHING.

◁ 3 ▷

| PATTERN | VOLUME OF INK DROP OF FLUSHING |
|---|---|
| 1 | 0.005 ml |
| 2 | 0.01 ml |
| 3 | 0.015 ml (STANDARD) |
| 4 | 0.02 ml |
| 5 | 0.025 ml |

FIG. 11

216

SETTING OF TIMING OF FLUSHING

PLEASE SELECT TIMING DURING WHICH FLUSHING IS PERFORMED.

◁ 1 ▷

| PATTERN | TIMING OF FLUSHING |
|---|---|
| 1 | 1 PASS (STANDARD) |
| 2 | 2 PASS |
| 3 | 3 PASS |
| 4 | 4 PASS |
| 5 | 5 PASS |

STANDARD INK (C)

STANDARD INK (M)

STANDARD INK (Y)

STANDARD INK (B)

STANDARD INK (COMBINATION)

INK A1 BY COMPANY A (C)

INK A1 BY COMPANY A (M)

INK A1 BY COMPANY A (Y)

INK A1 BY COMPANY A (B)

INK A1 BY COMPANY A (COMBINATION)

| | NUMBER OF TIMES | VOLUME |
|---|---|---|
| STANDARD INK | ±0 | ±0 |
| INK A1 BY COMPANY A | +400 | +1 |
| INK B1 BY COMPANY B | +50 | ±0 |
| INK C1 BY COMPANY C | ±0 | +1 |

LIQUID EJECTING APPARATUS, FLUSHING ADJUSTING METHOD, CONTROL PROGRAM OF LIQUID EJECTING APPARATUS, AND RECORDING MEDIUM

BACKGROUND

1. Technical Field

The present invention relates to a liquid ejecting apparatus having a liquid ejecting head which ejects droplets from a nozzle, a flushing adjusting method, a control program of the liquid ejecting apparatus, and a recording medium.

2. Related Art

As a liquid ejecting apparatus, for example, an ink jet recording apparatus which performs printing on a medium to be ejected such as a paper or a recording sheet by ejecting ink droplets as a liquid is known.

In the ink jet recording apparatus, since a nozzle which does not eject ink droplets during printing is exposed to the outside, ink in the nozzle which does not eject ink droplets and in a periphery of the nozzle is thickened by drying and an ejection error such as a deviation in the trajectory of an ink droplet due to thickened ink, clogging of the nozzle, or the like occurs. For this reason, flushing, in which ink droplets are ejected and ink in the nozzle and in the periphery of the nozzle is discharged, is performed on an area other than an area in which a recording head faces a medium at a predetermined timing such as before printing is started or during printing, for example, in a state of being stopped at a standby position or the like (for example, see JP-A-2009-90533).

However, since a condition for flushing is optimized so that a thickened ink in a nozzle and in a periphery of the nozzle is discharged in accordance with characteristics of a standard ink, if there is a change in the environment or if another ink other than a standard ink is used, there is a problem that a thickened ink cannot be reliably discharged by flushing optimized for the standard ink.

In addition, because of multiple manufacturers of an ink and a wide variety of inks, it is practically impossible to prepare in advance a condition optimized for flushing each type of ink and it is therefore difficult to set an optimum condition for flushing inks other than a standard ink.

Further, for example, for flushing in which approximately all types of inks are stably ejected, it may be possible to set a condition for flushing according to ink which is most likely to become thickened, but even in a case of using an ink which does not readily become thickened, it is necessary to perform extra flushing of an ink likely to become thickened, and there is a problem that wasteful ink consumption is increased.

Such a problem exists not only in an ink jet recording apparatus but also in a liquid ejecting apparatus which ejects a liquid other than ink in the same manner.

SUMMARY

An advantage of some aspects of the invention is that there are provided a liquid ejecting apparatus, a flushing adjusting method, a control program of the liquid ejecting apparatus, and a recording medium capable of suppressing an ejection error from occurring in accordance with a liquid and setting an optimum condition for flushing in which unnecessary consumption of the liquid is reduced.

According to an aspect of the invention, there is provided a liquid ejecting apparatus that performs ejection in which droplets are deposited onto a medium and flushing in which droplets are not deposited onto the medium, the apparatus including, a presentation unit that presents at least one condition selected from a number of times of ejecting droplets in the one flushing, a weight per one of the droplets in the flushing, and a timing of the flushing to be changeable by a user, and a flushing controller that controls the flushing to be performed based on the condition changed via the presentation unit.

In such an aspect, since a user can change a condition for flushing, even if liquids different from a standard liquid are used, an optimum flushing for the different liquids can be performed. Therefore, it is possible to reliably discharge a thickened liquid by flushing.

It is preferable that the flushing controller change at least one condition selected from the number of times of ejecting droplets in the one flushing, a weight per one of the droplets in the flushing, and a timing of the flushing and output a plurality of test patterns in accordance with the flushing performed under the changed condition. According to this, by outputting the test patterns, it is possible to determine a discharge state of a thickened liquid by flushing and the test patterns. In addition, it is possible to easily select a specific test pattern by outputting the plurality of test patterns and comparing a plurality of test patterns with each other. Further, since it is possible to select a condition for flushing by selecting the specific test pattern, it is possible to easily set an optimum condition for flushing in a short period of time as compared with a direct setting of the condition for flushing.

According to another aspect of the invention, there is provided a flushing adjusting method of a liquid ejecting apparatus that performs flushing in which a liquid is not deposited onto a medium, the method includes, changing at least one condition selected from a number of times of ejecting droplets in the one flushing, a weight per one of the droplets in the flushing, and a timing of the flushing and outputting a plurality of test patterns in accordance with the flushing performed under the changed condition, and setting the condition by selecting a specific test pattern among the plurality of test patterns.

In such an aspect, since a user can change a condition for flushing, even if liquids different from a standard liquid are used, an optimum flushing for the different liquids can be performed. Therefore, it is possible to reliably discharge a thickened liquid by flushing. In addition, by outputting the test patterns, it is possible to determine a discharge state of a thickened liquid by flushing and the test patterns. Further, it is possible to easily select a specific test pattern by outputting the plurality of test patterns and comparing a plurality of test patterns with each other. In addition, since it is possible to select a condition for flushing by selecting the specific test pattern, it is possible to easily set an optimum condition for flushing in a short period of time as compared with a direct setting of the condition for flushing.

It is preferable that the condition be set based on the condition selected via a presentation unit that presents the condition for the flushing to be changeable by a user. According to this, by selecting a condition by the user from a presentation unit which displays conditions to be changeable, it is possible to easily set the condition.

It is preferable that two conditions selected from the number of times of ejecting droplets in the one flushing, a weight per one of the droplets in the flushing, and a timing of the flushing be changed and the test patterns in accordance with the flushing executed under the two changed conditions be disposed and output in a matrix form onto the medium. According to this, it is possible to easily select a specific test pattern by outputting the plurality of test patterns and comparing a plurality of test patterns with each other. In addition, by disposing and outputting the plurality of test patterns in a matrix form, it is possible to easily compare the plurality of test patterns with each other.

It is preferable that the method further include outputting a plurality of test patterns by designating a change quantity and a change range of the condition after the test pattern is selected. According to this, it is possible to easily set a further optimum flushing condition in a short period of time.

It is preferable that by selecting a liquid, a change quantity of the condition of the flushing set in advance in association with the liquid be obtained and the plurality of test patterns obtained by changing the condition from the obtained change quantity be output. According to this, it is possible to easily set an optimum flushing condition for a specific liquid in a short period of time.

It is preferable that the specific test pattern be selected by outputting the plurality of test patterns when detecting replacement or replenishment of a liquid. According to this, it is possible to set an optimum condition for flushing even in a case where replacement or replenishment of the liquid is performed.

According to a still another aspect of the invention, there is provided a control program that realizes a function of adjusting flushing of a liquid ejecting apparatus that performs flushing in which a liquid is not deposited onto a medium, the function includes, changing at least one condition selected from a number of times of ejecting droplets in the one flushing, a weight per one of the droplets in the flushing, and a timing of the flushing and outputting a plurality of test patterns in accordance with the flushing performed under the changed condition, and setting the condition by selecting a specific test pattern among the plurality of test patterns.

In such an aspect, since a user can change a condition for flushing, even if liquids different from a standard liquid are used, a control program capable of performing an optimum flushing for the different liquids can be realized. In addition, by outputting the test patterns, it is possible to determine a discharge state of a thickened liquid by flushing and the test patterns. Further, it is possible to realize the control program capable of easily selecting a specific test pattern by outputting the plurality of test patterns and comparing a plurality of test patterns with each other. In addition, since it is possible to realize the control program capable of selecting a condition for flushing by selecting the specific test pattern, it is possible to easily set an optimum condition for flushing in a short period of time as compared with a direct setting of the condition for flushing.

According to a still another aspect of the invention, there is provided a computer-readable recording medium storing the control program according to the aspect.

In such an aspect, it is possible to realize the recording medium storing the control program.

BRIEF DESCRIPTION OF THE DRAWINGS

The invention will be described with reference to the accompanying drawings, wherein like numbers reference like elements.

FIG. 9 is a diagram illustrating a selection screen according to Embodiment 1.

FIG. 10 is a diagram illustrating a change screen according to Embodiment 1.

FIG. 11 is a diagram illustrating a change screen according to Embodiment 1.

DESCRIPTION OF EXEMPLARY EMBODIMENTS

Hereinafter, the invention will be described in detail based on embodiments.

Embodiment 1

Figure 1:
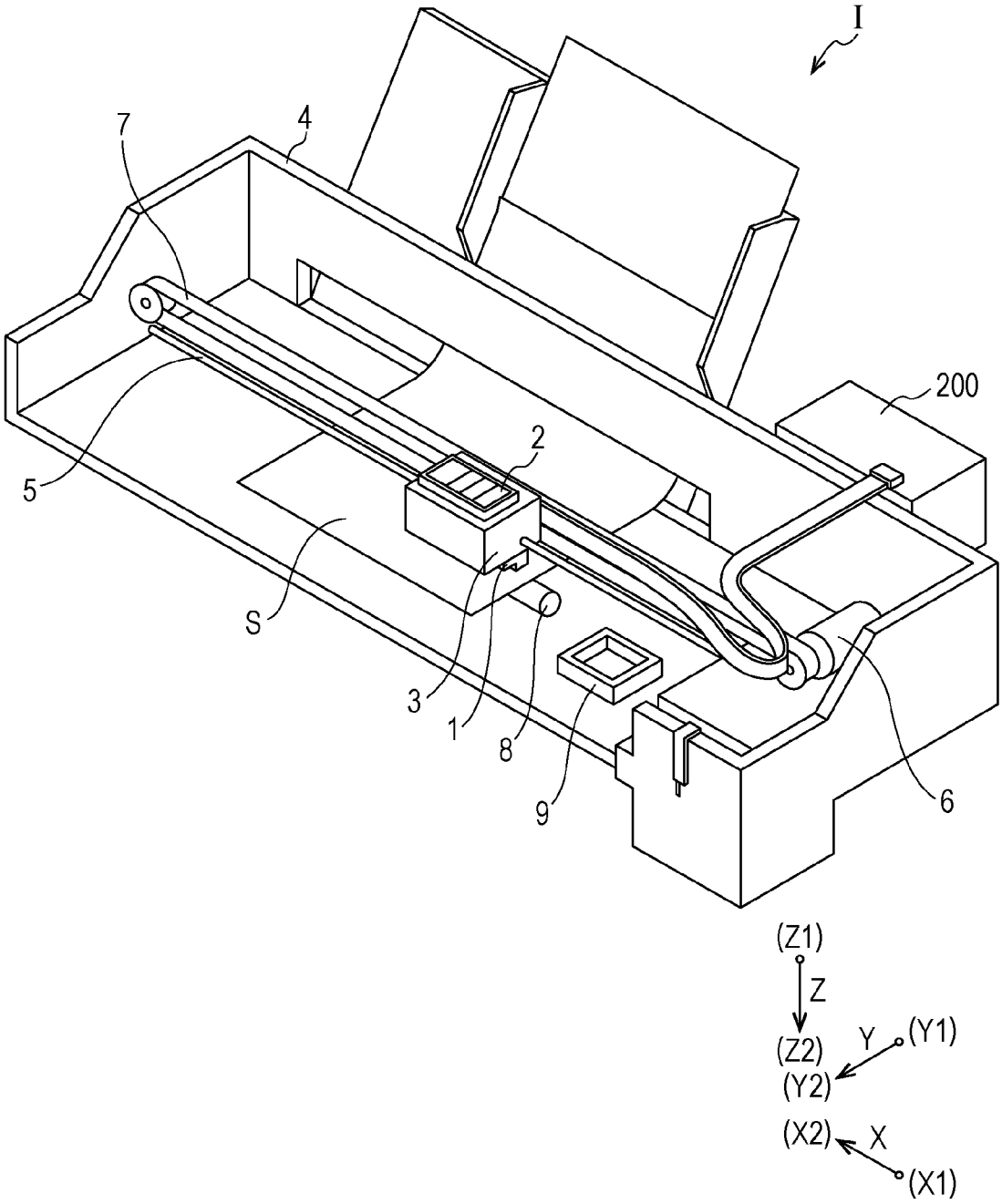
FIG. 1 is a schematic perspective view of a recording device according to Embodiment 1.

FIG. 1 is a perspective view illustrating a schematic configuration of an ink jet recording apparatus which is an example of a liquid ejecting apparatus according to Embodiment 1 of the invention.

As illustrated in FIG. 1, an ink jet recording apparatus I which is an example of the liquid ejecting apparatus of the present embodiment includes an ink jet recording head 1 (hereinafter, simply referred to as "recording head 1") which ejects an ink, as an example of a liquid, as ink droplets. The recording head 1 is mounted on a carriage 3 and the carriage 3 is provided on a carriage shaft 5 attached to the device main body 4 to be movable in an axial direction of the carriage shaft 5. In addition, an ink cartridge 2 constituting a liquid supply unit is detachably provided in the carriage 3. In the present embodiment, four recording heads 1 are mounted on the carriage 3 and different inks, for example, cyan (C), magenta (M), yellow (Y), and black (K) ink are ejected from each of the four recording heads 1 respectively. That is, the four ink cartridges 2 each of which holds a different ink are mounted on the carriage 3.

In response to a driving force of a driving motor 6 being transmitted to the carriage 3 via a plurality of gears (not illustrated) and a timing belt 7, the carriage 3 on which the recording head 1 is mounted reciprocates along the carriage shaft 5. On the other hand, a transport roller 8 is provided in the device main body 4 as a transport unit and a recording sheet S which is a medium to be ejected such as paper onto which an ink is deposited is transported by the transport roller 8. The transport unit which transports the recording sheet S is not limited to a transport roller and may be a belt, a drum, or the like. In the present embodiment, a direction of movement along the carriage shaft 5 of the carriage 3 is referred to as a "first direction X", and one end side of the carriage shaft 5 is referred to as "X1" and the other end side of the carriage shaft 5 is referred to as "X2". In addition, a transport direction of the recording sheet S is referred to as a "second direction Y", and an upstream side in a transport direction of the recording sheet S is referred to as "Y1" and a downstream side in a transport direction of the recording sheet S is referred to as "Y2". Further, in the present embodiment, a direction crossing both the second direction Y and the first direction X is referred to as a "third direction Z", and a recording head 1 side with respect to the recording sheet S is referred to as "Z1" and a recording sheet S side with respect to the recording head 1 is referred to as "Z2". In the present embodiment, although relationships between respective directions (X, Y, and Z) are orthogonal, the relationships are not limited to disposition relationships of respective components necessarily being orthogonal.

In the carriage 3, the X1, which is one end side of the carriage shaft 5, corresponds to a home position and a flushing box 9 which is an ink receiver receiving ink droplets ejected from the recording head 1 when flushing and a cleaning unit (not illustrated) which cleans a liquid ejecting surface 22 or the like of the recording head 1 are provided at the home position. The cleaning unit is, for example, a suction unit which sucks ink from a nozzle of the recording head 1, a wiping unit in which a wiper blade wipes the liquid ejecting surface 22 to which the nozzle is opened, or the like. In addition, a term "flushing" means to cause the recording head 1 to eject ink droplets of an ink so as not to be deposited from the recording head 1 onto the recording sheet S before or during printing and is also referred to as "preliminary ejection". By performing flushing of the recording head 1 and discharging a thickened ink from the nozzle, it is possible to suppress the occurrence of an ejection error, such as a deviation in the trajectory of an ink droplet or clogging of the nozzle during printing, and to suppress the occurrence of a depositing error, such as a deviation of a deposit target position, or a non-deposit ejection error of ink droplets. Meanwhile, in the present embodiment, the flushing box 9 is provided at only X1, but the embodiment is not limited thereto. The flushing box 9 may be provided at X2 and may be provided at both of X1 and the X2. By providing the flushing box 9 at both of X1 and X2, it is possible to perform flushing twice during so-called one-pass printing during which the carriage 3 reciprocates in the first direction X.

In the ink jet recording apparatus I, the recording sheet S is transported in the second direction Y with respect to the recording head 1 and the carriage 3 is reciprocated in the first direction X with respect to the recording sheet S, so that printing is performed over an approximately the entire surface of the recording sheet S by ejecting ink droplets from the recording head 1.

Figure 2:
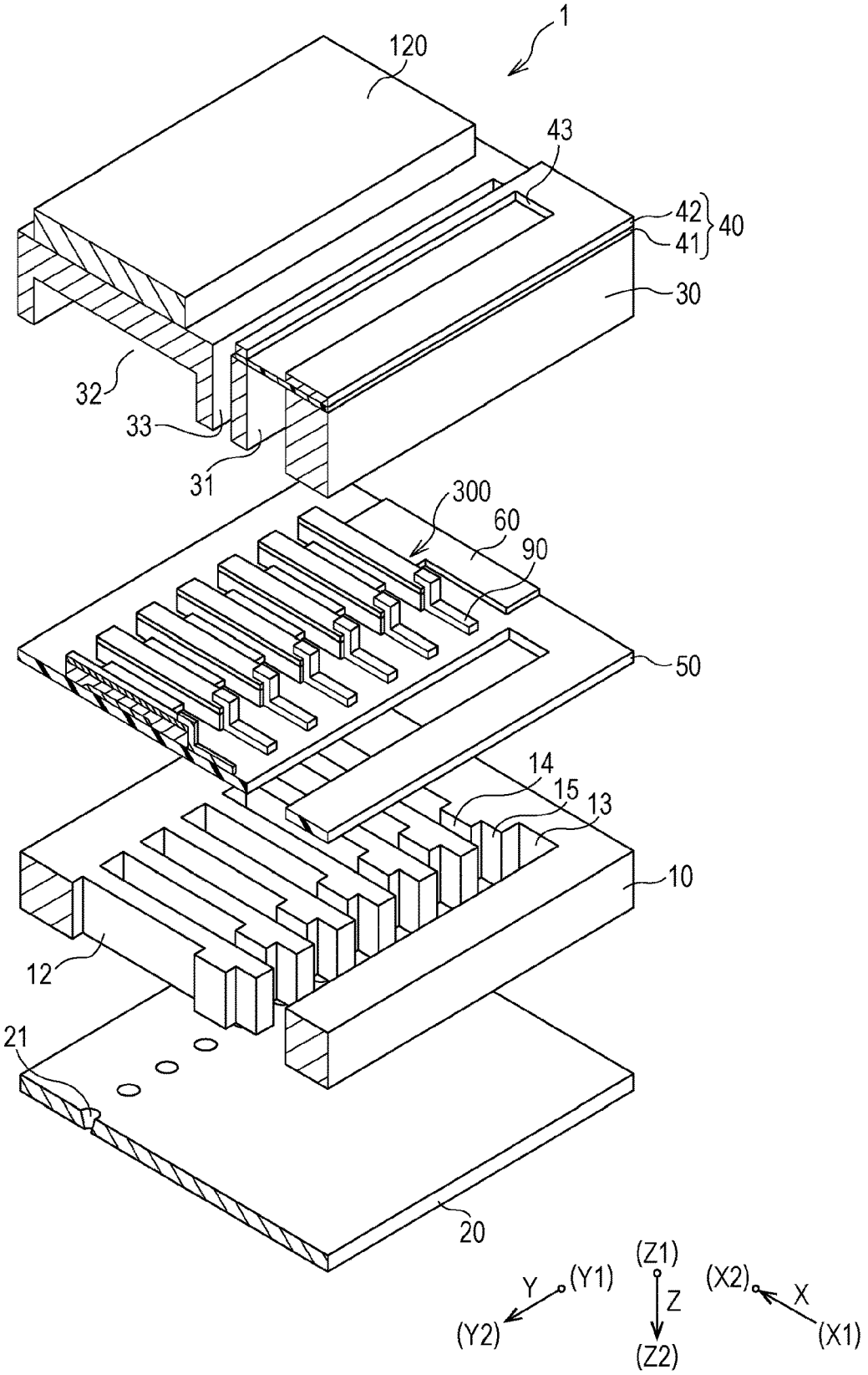
FIG. 2 is an exploded perspective view of a recording head according to Embodiment 1.
Figure 3:
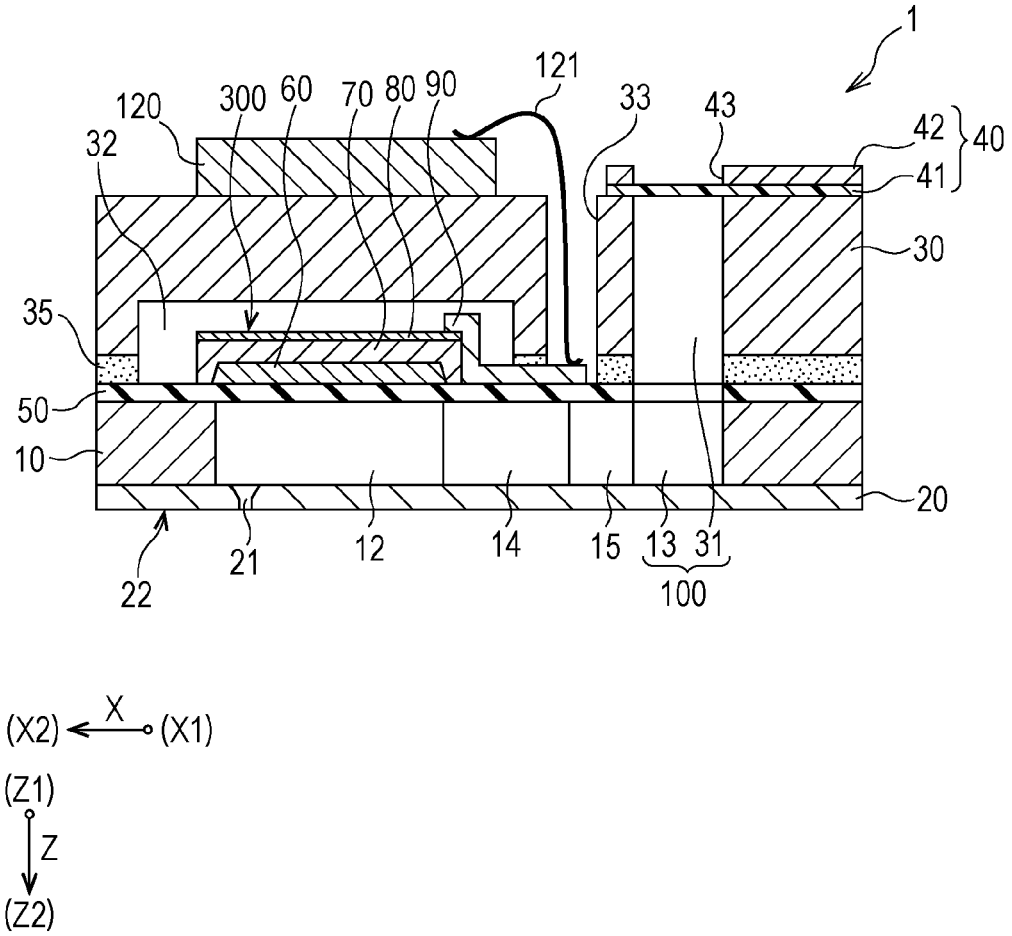
FIG. 3 is a cross-sectional view of the recording head according to Embodiment 1.

Here, an example of the recording head 1 mounted on the ink jet recording apparatus I will be described with reference to FIGS. 2 and 3. FIG. 2 is an exploded perspective view illustrating an ink jet recording head which is an example of a liquid ejecting head according to Embodiment 1 of the invention, and FIG. 3 is a cross-sectional view of the recording head in the second direction Y. In addition, in the present embodiment, directions of the recording head will be described based on directions when the recording head is mounted on the ink jet recording apparatus I, that is, the first direction X, the second direction Y, and the third direction Z. A disposition of the recording head 1 in the ink jet recording apparatus I is not limited to the following.

As illustrated in FIGS. 2 and 3, a flow-path-forming substrate 10 constituting the recording head 1 of the present embodiment is a silicon single crystal substrate, and a diaphragm 50 is formed on one surface of the flow-path-forming substrate 10. The diaphragm 50 may be a single layer or a stacked layer selected from a silicon dioxide layer or a zirconium oxide layer.

A plurality of pressure generating chambers 12 are juxtaposed in the flow-path-forming substrate 10 in the second direction Y. In addition, a communicating unit 13 is formed in an area beyond the pressure generating chamber 12 of the flow-path-forming substrate 10 in the first direction X, and the communicating unit 13 and each of the pressure generating chambers 12 communicate with each other via an ink supply path 14 and a communicating path 15 provided in each of the pressure generating chambers 12. The communicating unit 13 communicates with a manifold unit 31 of a protective substrate to be described below and constitutes a part of a manifold 100, which is an ink chamber common to each of the pressure generating chambers 12. The ink supply path 14 is formed with a width narrower than the pressure generating chamber 12 width and constantly maintains a flow-path-resistance of ink flowing from the communicating unit 13 to the pressure generating chamber 12.

In addition, a nozzle plate 20 on which a nozzle 21, which communicates with a periphery of an end tip on an opposite side of the ink supply path 14 of each of the pressure generating chambers 12, is formed is fixed on a surface on a Z2 side in the third direction Z of the flow-path-forming substrate 10. The nozzle plate 20 is made of, for example, glass ceramic, a silicon single crystal substrate, stainless steel, or the like. In addition, a surface on a Z2 side, to which the nozzle 21 of the nozzle plate 20 is opened, is the liquid ejecting surface 22 of the present embodiment.

On the other side, the diaphragm 50 is formed on a surface on a Z1 side of the flow-path-forming substrate 10, and a piezoelectric actuator 300 is formed of a first electrode 60, a piezoelectric layer 70, a second electrode 80 stacked on the diaphragm 50 by film formation and a lithography method. In the present embodiment, the piezoelectric actuator 300 is a driving element which causes a pressure change in ink in the pressure generating chamber 12. Here, the piezoelectric actuator 300 is also referred to as a piezoelectric element 300 and is a portion including the first electrode 60, the piezoelectric layer 70, and the second electrode 80. In general, one electrode of the piezoelectric actuator 300 is used as a common electrode and the other electrode and the piezoelectric layer 70 are patterned for each of the pressure generating chambers 12. In the present embodiment, the first electrode 60 is used as a common electrode of the piezoelectric actuator 300, and the second electrode 80 is used as an individual electrode of the piezoelectric actuator 300, however the first electrode 60 and the second electrode 80 may be reversed for convenience of a driving circuit and wiring. In the example described above, the diaphragm 50 and the first electrode 60 are operated as diaphragms, but the example is not limited thereto and only the first electrode 60 may be operated as a diaphragm without being provided with the diaphragm 50. In addition, the piezoelectric actuator 300 itself may also practically serve as a diaphragm.

In addition, a lead electrode 90 is connected to the second electrode 80 of each of the piezoelectric actuators 300, and a voltage is selectively applied to each of the piezoelectric actuators 300 via the lead electrode 90.

In addition, a protective substrate 30 including the manifold unit 31 constituting at least a portion of the manifold 100 is joined to a surface on a piezoelectric actuator 300 side of the flow-path-forming substrate 10 via an adhesive 35. In the present embodiment, the manifold unit 31 is formed orthogonal to a width direction of the pressure generating chamber 12 and extends into the protective substrate 30 in the third direction Z, and the manifold unit 31 in communication with the communicating unit 13 of the flow-path-forming substrate 10 as described above and constitutes the manifold 100 which is an ink chamber common to each of the pressure generating chambers 12.

In addition, a piezoelectric actuator holding unit 32 having a space not interfering with a movement of the piezoelectric actuator 300 is provided in an area of the protective substrate 30 facing the piezoelectric actuator 300. The piezoelectric actuator holding unit 32 may have a space not interfering with a movement of the piezoelectric actuator 300, and the space may be sealed or not sealed.

As the protective substrate 30, it is preferable to use a material having approximately the same thermal expansion coefficient as that of the flow-path-forming substrate 10, for example, glass, a ceramic material, or the like. In the present embodiment, a silicon single crystal substrate of the same material as the flow-path-forming substrate 10 is used to form the protective substrate 30.

In addition, a through-hole 33 which penetrates the protective substrate 30 in the third direction Z is provided in the protective substrate 30. A periphery of an end tip of the lead electrode 90 drawn out from each of the piezoelectric actuators 300 is provided so as to be exposed in the through-hole 33.

In addition, a driving circuit 120 for driving the piezoelectric actuator 300 is provided on a surface on a Z1 side of the protective substrate 30. As the driving circuit 120, for example, a circuit substrate, a semiconductor integrated circuit (IC), or the like can be used. The driving circuit 120 and the lead electrode 90 are electrically connected via a connection wiring 121 made of a conductive wire such as a bonding wire.

In addition, a compliance substrate 40 formed of a sealing film 41 and a fixing plate 42 is joined to a surface on a Z1 side of the protective substrate 30. Here, the sealing film 41 is made of a material having low rigidity and flexibility, and one surface of the manifold unit 31 is sealed by the sealing film 41. In addition, the fixing plate 42 is made of a relatively hard material. Since an area of the fixing plate 42 facing the manifold 100 is an opening 43 which is completely open in a thickness direction, one surface of the manifold 100 is sealed with only the sealing film 41 having flexibility.

In the recording head 1 of the present embodiment, after ink is obtained from the ink cartridge 2 illustrated in FIG. 1 and the nozzle 21 is filled with ink from the manifold 100, pressure in each of the pressure generating chambers 12 increases, and ink droplets are ejected from the nozzles 21 by applying power between the first electrode 60 and the second electrode 80 corresponding to the pressure generating chamber 12 according to a driving signal from the driving circuit 120 and causing the diaphragm 50 and the piezoelectric actuator 300 to deform flexures.

Figure 4:
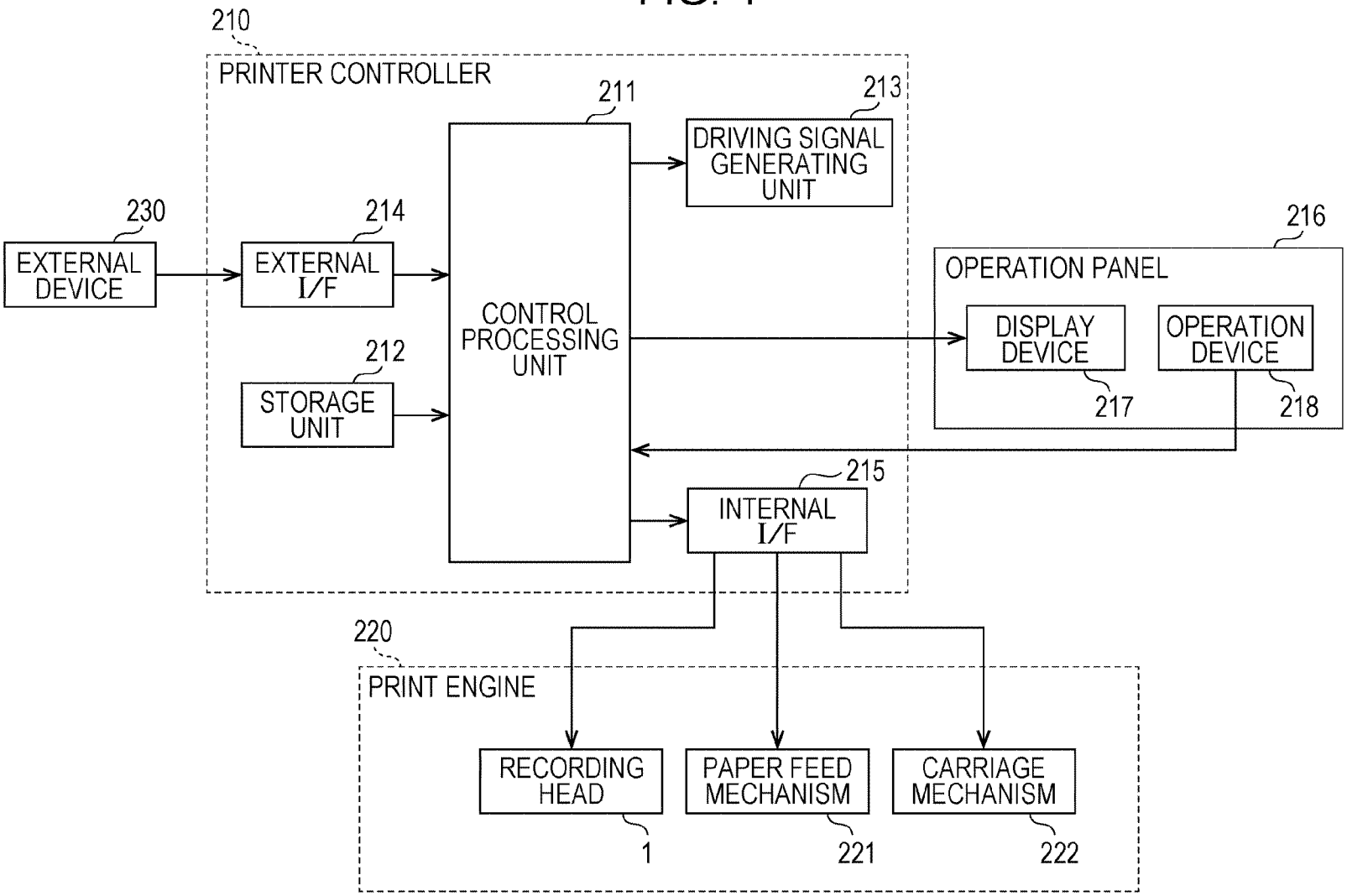
FIG. 4 is a block diagram illustrating an electrical configuration of the recording device according to Embodiment 1.

In addition, as illustrated in FIG. 1, the ink jet recording apparatus I includes a control device 200. Here, an electrical configuration of the ink jet recording apparatus I of the present embodiment will be described with reference to FIG. 4. FIG. 4 is a block diagram illustrating an electrical configuration of the ink jet recording apparatus according to Embodiment 1 of the invention.

As illustrated in FIG. 4, the ink jet recording apparatus I includes a printer controller 210 which is a controller of the present embodiment, a print engine 220, and an operation panel 216.

The printer controller 210 is an element which controls the overall ink jet recording apparatus I and is provided in the control device 200 provided in the ink jet recording apparatus I of the present embodiment.

In addition, the printer controller 210 has a control processing unit 211 formed of a CPU and the like, a storage unit 212, a driving signal generating unit 213, an external interface (I/F) 214, an internal I/F 215, and the operation panel 216.

Printing data indicating an image to be printed on the recording sheet S is transmitted from an external device 230 such as a host computer or the like to the external I/F 214, and the print engine 220 is connected to the internal I/F 215. The print engine 220 is an element which records an image on the recording sheet S under control of the printer controller 210 and has the recording head 1, a paper feed mechanism 221 such as the transport roller 8, a motor (not illustrated) for driving the transport roller 8, or the like, and a carriage mechanism 222 such as the driving motor 6, the timing belt 7, or the like.

The storage unit 212 includes a ROM on which a control program and the like are stored and a RAM which temporarily stores various types of data necessary for printing an image.

The control processing unit 211 comprehensively controls each of the elements of the ink jet recording apparatus I by running a control program stored in the storage unit 212. In addition, the control processing unit 211 converts printing data transmitted from the external device 230 to the external I/F 214 into a head-control signal for instructing each of the piezoelectric actuators 300 to perform injection/non-injection of ink droplets from each of the nozzles 21 of the recording head 1, for example, a clock signal CLK, a latch signal LAT, a change signal CH, pixel data SI, setting data SP, or the like and transmits the head-control signal to the recording head 1 via the internal I/F 215. Further, the driving signal generating unit 213 generates a driving signal (COM) and transmits the driving signal to the recording head 1 via the internal I/F 215. That is, head-control data and ejection data such as a driving signal or the like are transmitted to the recording head 1 via the internal I/F 215 which is a transmission unit.

The recording head 1, to which ejection data such as a head-control signal, a driving signal, and the like are applied from the printer controller 210, generates an application pulse from a head-control signal and a driving signal and applies the application pulse to the piezoelectric actuator 300.

In addition, the control processing unit 211 generates movement control signals for the paper feed mechanism 221 and the carriage mechanism 222 from printing data received from the external device 230 via the external I/F 214, transmits the movement control signals to the paper feed mechanism 221 and the carriage mechanism 222 via the internal I/F 215, and controls the paper feed mechanism 221 and the carriage mechanism 222. Accordingly, printing is performed on the recording sheet S.

The operation panel 216 includes a display device 217 and an operation device 218. The display device 217 is formed of, for example, a liquid crystal display, an organic EL display, an LED lamp, and the like and displays various types of information. The operation device 218 is formed of various switches, a touch panel, and the like.

Figure 5:
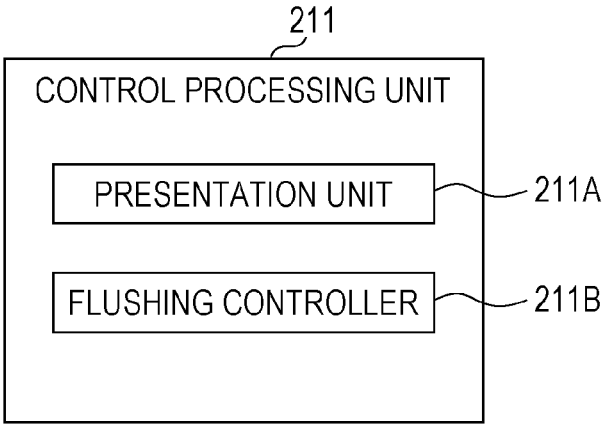
FIG. 5 is a block diagram illustrating a function realizing unit of a control processing unit according to Embodiment 1.

In addition, the control processing unit 211 presents a condition for flushing that can be changed by a user of the ink jet recording apparatus I via one or both of the operation panel 216 and the external device 230. Then, the control processing unit 211 controls flushing to be performed based on a condition changed by the user. That is, as illustrated in FIG. 5, by running a control program stored in the storage unit 212, the control processing unit 211 realizes a function as a presentation unit 211A which presents a condition for flushing that can be changed by the user via one or both of the operation panel 216 and the external device 230. In addition, by executing a control program stored in the storage unit 212, the control processing unit 211 realizes a function as a flushing controller 211B which instructs flushing to be performed based on the condition changed via the presentation unit 211A. Such a control program is read from a non-transitory computer-readable recording medium such as a floppy disk, a CD-ROM, a DVD-ROM, a USB memory, or the like directly connected via the external I/F 214 or connected via a host computer. The control program may be provided as a printer driver in the host computer. In a case where the control program is provided in the host computer, a flushing controller and a presentation unit described in the claims become a host computer having a control program. The presentation unit 211A may present a condition for flushing that can be changed by a user via one of the operation panel 216 and the external device 230 or both of the operation panel 216 and the external device 230. Of course, a target to be presented by the presentation unit 211A may be selected by the user.

Here, an optimum condition for flushing to prevent an ink droplet ejection error from occurring ink droplets is set in the printer controller 210 in accordance with physical properties of a standard ink in an initial state. However, in an actual case, ink other than the standard ink may be used depending on user needs. The ink other than the standard ink may be ink having different components made by the same manufacturer as the standard ink or ink made by another manufacturer. In a case of using ink different from the standard ink, since there is a difference in a rate of thickening per unit time, even for inks with the same drying time, for example, in a case where the ink is thickened more than the standard ink, the thickened ink cannot be completely discharged under a condition for flushing in the initial state. For this reason, there is a possibility that an ejection error of ink droplets such as occurrence of a deviation in the trajectory of the ink droplet due to thickened ink remaining without being completely discharged or ejection of ink droplet such as clogging of the nozzles 21 may occur. In the ink jet recording apparatus I of the present embodiment, when using ink different from the standard ink, it is possible to activate a flushing adjustment mode in which a user can change a standard condition for flushing set in accordance with the standard ink to a condition for the different ink. For example, the flushing adjustment mode can be activated by a user operating the operation device 218.

Here, as a condition for flushing, the number of times of ejecting ink droplets in one flushing (condition 1), a weight per one ink droplet in flushing (condition 2), and a timing of flushing (condition 3) are used.

The number of times of ejecting ink droplets in one flushing, which is the condition 1, is the number of times that ink droplets are continuously ejected from the same nozzle 21 in one flushing. Since it is necessary to perform flushing until a thickened ink in the nozzle 21 and in a periphery of the nozzle 21 is discharged to the outside by flushing, in a case of thickened ink, the number of times of ejecting ink droplets in one flushing is increased. Accordingly, it possible to increase a discharge quantity of the ink in flushing and to reliably discharge the thickened ink. On the other hand, in a case of ink which does not readily become thickened, by decreasing the number of times of ejecting ink droplets in one flushing, a discharge quantity of ink in flushing can be decreased and unnecessary ink consumption can be suppressed.

In addition, a weight per one ink droplet in flushing which is the condition 2 is an ink weight per one ink droplet when a plurality of ink droplets are ejected in one flushing. For example, in a case of a thickened ink, an ink weight per one ink droplet is increased. Accordingly, it possible to increase a discharge quantity of the ink in flushing and to reliably discharge the thickened ink. On the other hand, in a case of ink which does not readily become thickened, by decreasing an ink weight per one ink drop, a discharge quantity of an ink in flushing can be decreased and unnecessary ink consumption can be suppressed.

Figure 6:
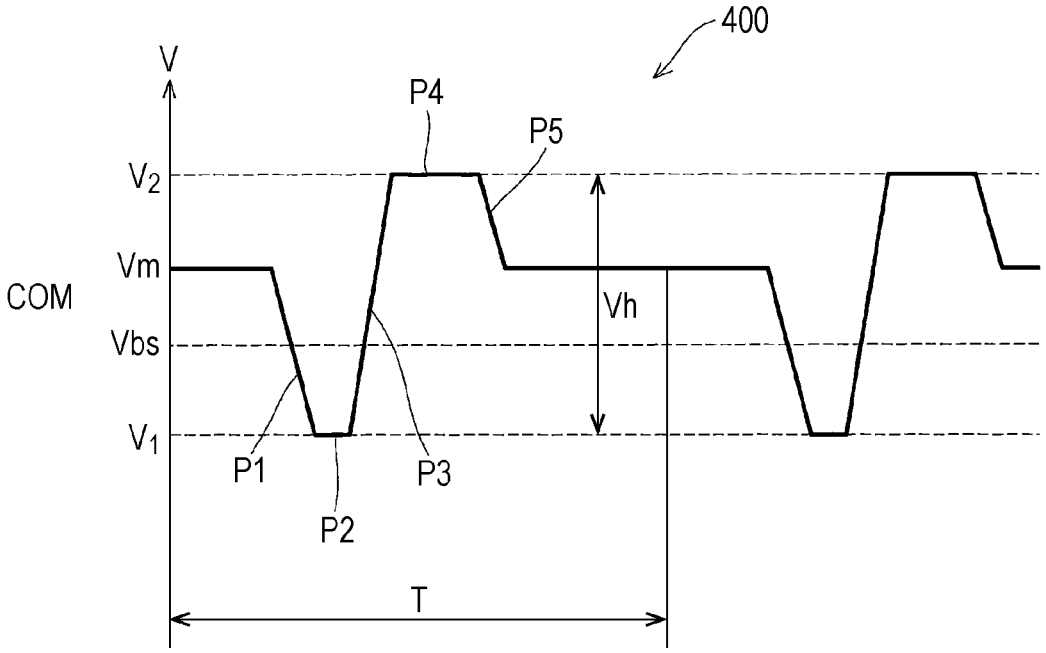
FIG. 6 is a waveform diagram illustrating an example of a driving pulse according to Embodiment 1.

A weight of an ink droplet can be adjusted by, for example, adjusting a driving pulse indicating a driving signal for driving the piezoelectric actuator 300. Here, an example of a driving pulse performing flushing will be described in FIG. 6. FIG. 6 is a waveform diagram illustrating a driving pulse according to the present embodiment.

A driving signal (COM) generated by the driving signal generating unit 213 has a driving pulse for ejecting ink droplets from the nozzle 21 within one recording cycle T (frequency 1/T).

As illustrated, the driving pulse is supplied to the second electrode 80, which is an individual electrode, with the first electrode 60, which is a common electrode of the piezoelectric actuator 300, as a standard potential (Vbs). That is, a voltage applied to the second electrode 80 by a driving waveform is illustrated with the standard potential (Vbs) as a reference.

Specifically, a driving pulse 400 includes an expansion element P1 which expands a volume of the pressure generating chamber 12 from a standard volume by applying a voltage from a state in which an intermediate potential Vm is applied to a first potential $V_1$, an expansion maintaining element P2 which maintains the volume of the pressure generating chamber 12 expanded by the expansion element P1, a contraction element P3 which contracts the volume of the pressure generating chamber 12 by applying a potential difference Vh from the first potential $V_1$ to a second potential $V_2$, a contraction maintaining element P4 which maintains the volume of the pressure generating chamber 12 contracted by the contraction element P3 for a certain time, and an expansion returning element P5 which returns the pressure generating chamber 12 from a contraction state of the second potential $V_2$ to the standard volume of the intermediate potential Vm.

In a case of adjusting an ink weight per one ink droplet in flushing on the condition 2, for example, the potential difference Vh of the driving pulse 400 may be changed. For example, in a case of increasing an ink weight per one ink drop, the potential difference Vh may be increased and in a case of decreasing the ink weight per one ink drop, the potential difference Vh may be increased. For adjustment of the ink weight, for example, a user designates the ink weight based on a table or the like illustrating a correlation between the ink weight and the potential difference Vh, so that the potential difference Vh may be referred to from the designated ink weight. Of course, instead of allowing the user to select the ink weight, the potential difference Vh may be selected. In addition, in the present embodiment, a weight of an ink droplet is adjusted by changing the potential difference Vh applied to the piezoelectric actuator 300, but other elements may be changed as long as the weight of an ink droplet can be changed. For example, a potential change rate of the contraction element P3 per unit time, that is, a gradient, a potential difference between the intermediate potential Vm and the first potential $V_1$, a maintaining time of the expansion maintaining element P2, and the like can be changed. In addition, in a case of separately printing a large dot, a medium dot, a small dot, and the like during printing, if flushing is performed by selecting different driving pulses to be used for separate printing, it is possible to adjust a weight of an ink drop.

Further, a timing of flushing on the condition 3 is a timing at which flushing is performed during printing. For example, in a case of a thickened ink, if flushing is performed every time the carriage 3 reciprocates once (one-pass printing) in the first direction X during printing, it is possible to shorten an interval of flushing and to reliably discharge the thickened ink. On the other hand, if flushing is performed every time the carriage 3 reciprocates twice (two passes) in the first direction X during printing, it is possible to lengthen the interval of flushing, to decrease a discharge quantity of ink in flushing, and to suppress unnecessary ink consumption.

The presentation unit 211A presents at least one of these three conditions 1 to 3 for flushing to the operation panel 216 and the external device 230 so as to be changeable by a user. The presentation unit 211A may present only one condition among the conditions 1 to 3 to be changeable by the user and may present two conditions selected from the conditions 1 to 3 to be changeable by the user. In addition, the presentation unit 211A causes the user to select some of the conditions 1 to 3 and may present the selected the conditions 1 to 3 to be changeable by the user.

Here, examples in which the presentation unit 211A displays a condition for flushing to be changeable by a user on the operation panel 216 are illustrated in FIGS. 7 to 11. FIGS. 7 to 11 are diagrams illustrating selection screens.

Figure 7:
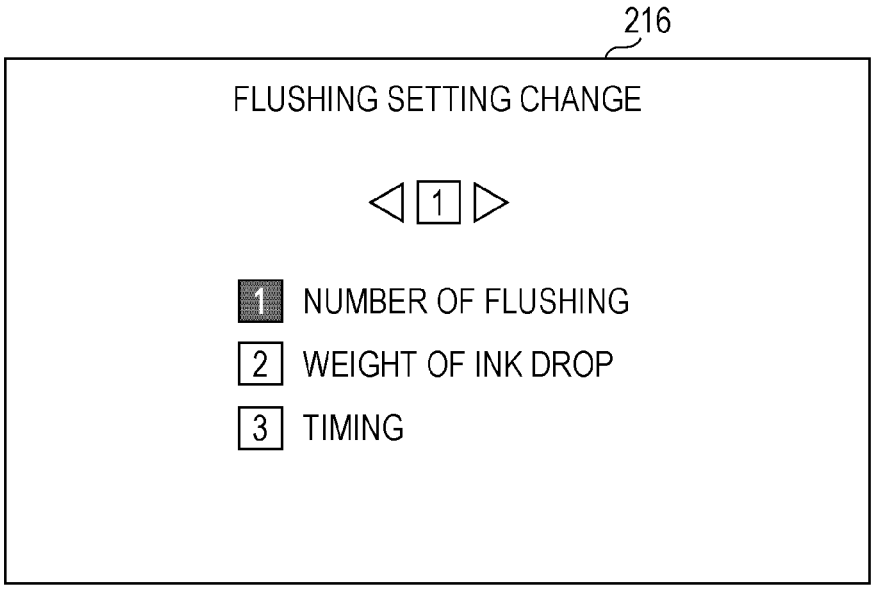
FIG. 7 is a diagram illustrating a selection screen according to Embodiment 1.
Figure 8:
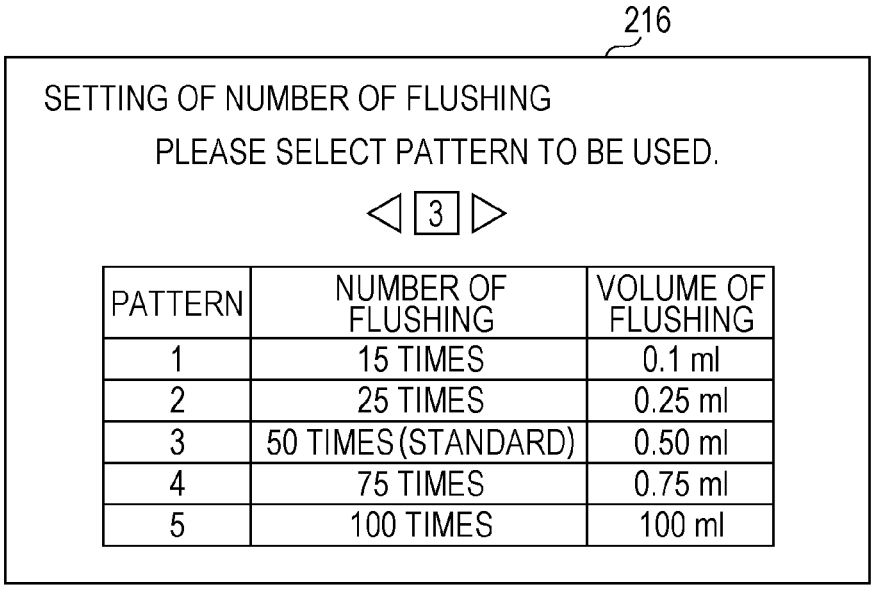
FIG. 8 is diagram illustrating a selection screen according to Embodiment 1.

As illustrated in FIG. 7, the presentation unit 211A presents the conditions 1 to 3 to be selectable by a user to the operation panel 216. In a case where the user selects the condition 1, the presentation unit 211A presents values of the condition 1 for flushing to be changeable by the user as illustrated in FIG. 8. In the example illustrated in FIG. 8, five different values of the condition 1 are prepared in advance and can be changed by the user selecting a desired value among the five different values of the condition 1. Of course, the example is not limited thereto, as illustrated in FIG. 9, the user can directly input and change the number of times (condition 1) of ejecting ink droplets in one flushing. In the examples illustrated in FIGS. 8 and 9, a standard condition 1 for flushing suitable for a standard ink is displayed so that the user can understand the condition 1. For this reason, since the condition 1 can be changed with respect to the standard ink, the same condition 1 can be selected as the condition 1 for the standard ink and a change quantity can be easily recognized when changing the condition 1.

In addition, in a case where a user selects the condition 2 in a screen illustrated in FIG. 7, values of the condition 2 for flushing is presented to be changeable as illustrated in FIG. 10. In the example illustrated in FIG. 10, five different values of the condition 2 are prepared in advance and can be changed by the user selecting a desired value among the five different values of the condition 2. Of course, in the same manner for the condition 2 as FIG. 9, the user also can directly input and designate the values of the condition 2.

Further, in a case where a user selects the condition 3 in a screen illustrated in FIG. 7, values of the condition 3 for flushing is presented to be changeable as illustrated in FIG. 11. In the example illustrated in FIG. 11, five different values of the condition 3 are prepared in advance and can be changed by the user selecting a desired value among the five different values of the condition 3. Of course, in the same manner for the condition 3 as FIG. 9, the user also can directly input and designate the values of the condition 3.

Figure 12:
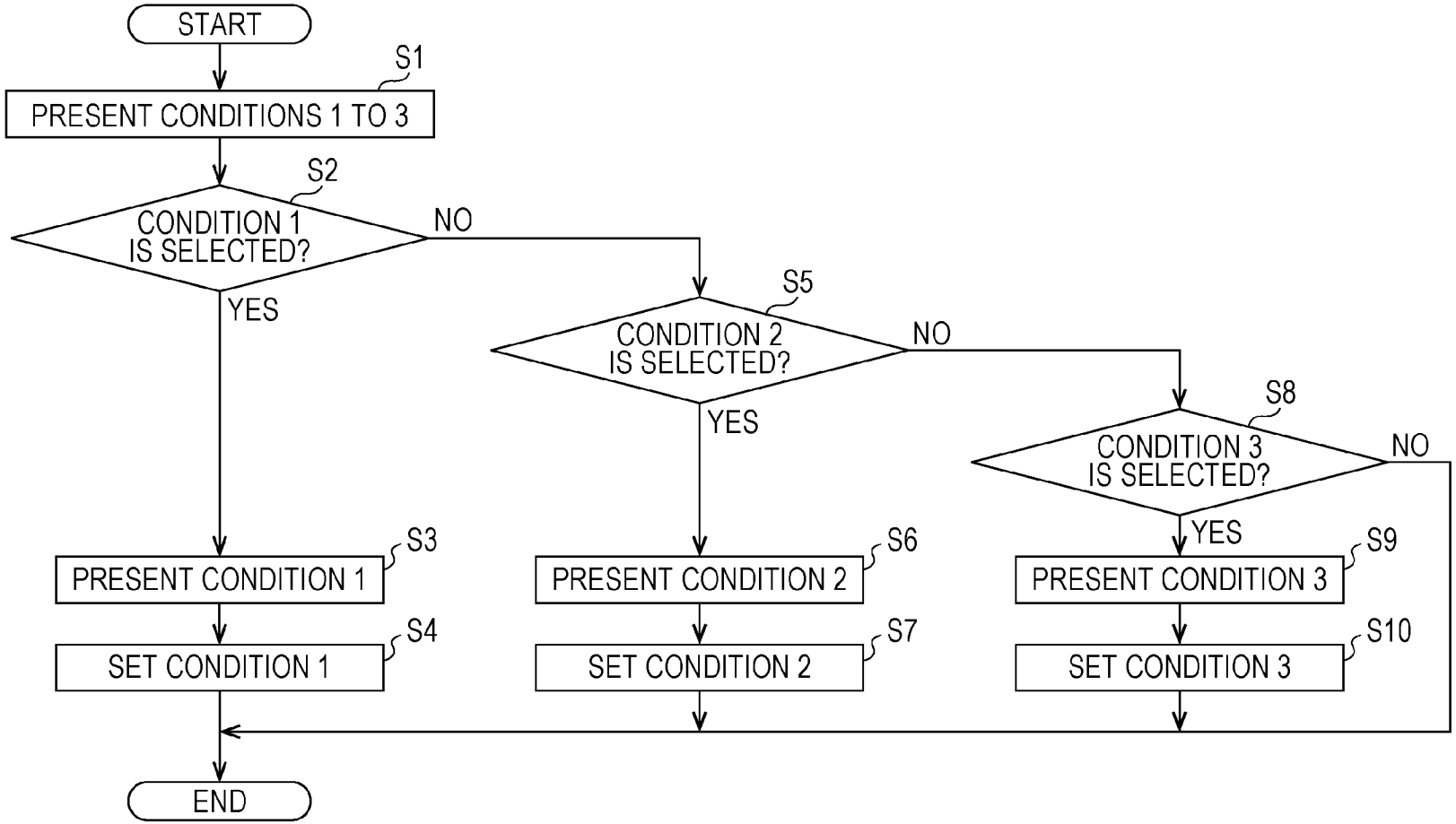
FIG. 12 is a flowchart illustrating an adjusting method according to Embodiment 1.

A flushing adjusting method in which the conditions 1 to 3 for flushing are set will be described with reference to FIG. 12. FIG. 12 is a flowchart illustrating a flushing adjusting method according to Embodiment 1 of the invention.

As illustrated in FIG. 12, in step S1, the presentation unit 211A presents the conditions 1 to 3 illustrated in FIG. 7 described above so that a user can select the conditions 1 to 3. In step S2, it is determined whether or not the condition 1 is selected. If the condition 1 is selected (Yes in step S2), in step S3, the presentation unit 211A displays values of the condition 1 for flushing in a state in which the values can be changed as illustrated in FIGS. 8 and 9. Then, if the user selects the values of the condition 1 presented by the presentation unit 211A, in step S4, the flushing controller 211B sets the condition 1 changed via the presentation unit 211A.

In addition, in a case where the condition 1 is not selected in step S2 (No in step S2), it is determined whether or not the condition 2 is selected in step S5. If the condition 2 is selected (Yes in step S5), in step S6, the presentation unit 211A displays values of the condition 2 for flushing so that the values can be changed as illustrated in FIG. 10. Then, if the user selects the values of the condition 2 presented by the presentation unit 211A, in step S7, the flushing controller 211B sets the condition 2 changed via the presentation unit 211A.

Further, in a case where the condition 2 is not selected in step S5 (No in step S5), it is determined whether or not the condition 3 is selected in step S8. If the condition 3 is selected (Yes in step S8), in step S9, the presentation unit 211A displays values of the condition 3 for flushing so that the values can be changed as illustrated in FIG. 11. Then, if the user selects the values of the condition 3 presented by the presentation unit 211A, in step S10, the flushing controller 211B sets the condition 3 changed via the presentation unit 211A. In a case where the condition 3 is not selected in step S8 (No in step S8), standard conditions 1 to 3 for flushing are set as it is without changing the conditions 1 to 3.

In the present embodiment, in the flushing adjustment mode, a user selects the conditions 1 to 3 and changes the values of the selected conditions 1 to 3, but the embodiment is not limited thereto. Without selecting the conditions 1 to 3, at least one selected from the conditions 1 to 3 may be always changed by the user.

As described above, in the ink jet recording apparatus I of the present embodiment, the presentation unit 211A presents at least one condition selected from the number of times of ejecting ink droplets in one flushing (condition 1), a weight per one ink droplet in flushing (condition 2), and a timing of flushing (condition 3) to the operation panel 216 or the external device 230 so that the user can change the condition and the flushing controller 211B controls flushing to be performed based on the condition changed via the presentation unit 211A. For this reason, even with ink different from a standard ink, optimum flushing can be performed, it is possible to reliably discharge a thickened ink and to suppress unnecessary ink consumption. That is, normally, since a condition for flushing is optimized so that a thickened ink in the nozzle 21 and in a periphery of the nozzle 21 is discharged in accordance with characteristics of a standard ink, by being changed not only a possible environmental but also another ink other than a standard ink, other ink cannot be stably ejected in flushing optimized for the standard ink. In the present embodiment, since a user can set an optimum condition for flushing with respect to ink different from the standard ink, it is possible to reliably discharge a thickened ink and to suppress an ejection error of the ink.

In addition, since the user can set a condition for flushing for each of inks, it is unnecessary to prepare all of flushing conditions corresponding to various types of ink and it is possible to easily set the condition.

Further, in the present embodiment, since the user can set an optimum condition for flushing with respect to ink different from the standard ink, it is unnecessary to set a flushing condition in accordance with the most thickest ink. Therefore, it is possible to suppress unnecessary ink consumption.

Embodiment 2

Figure 13:
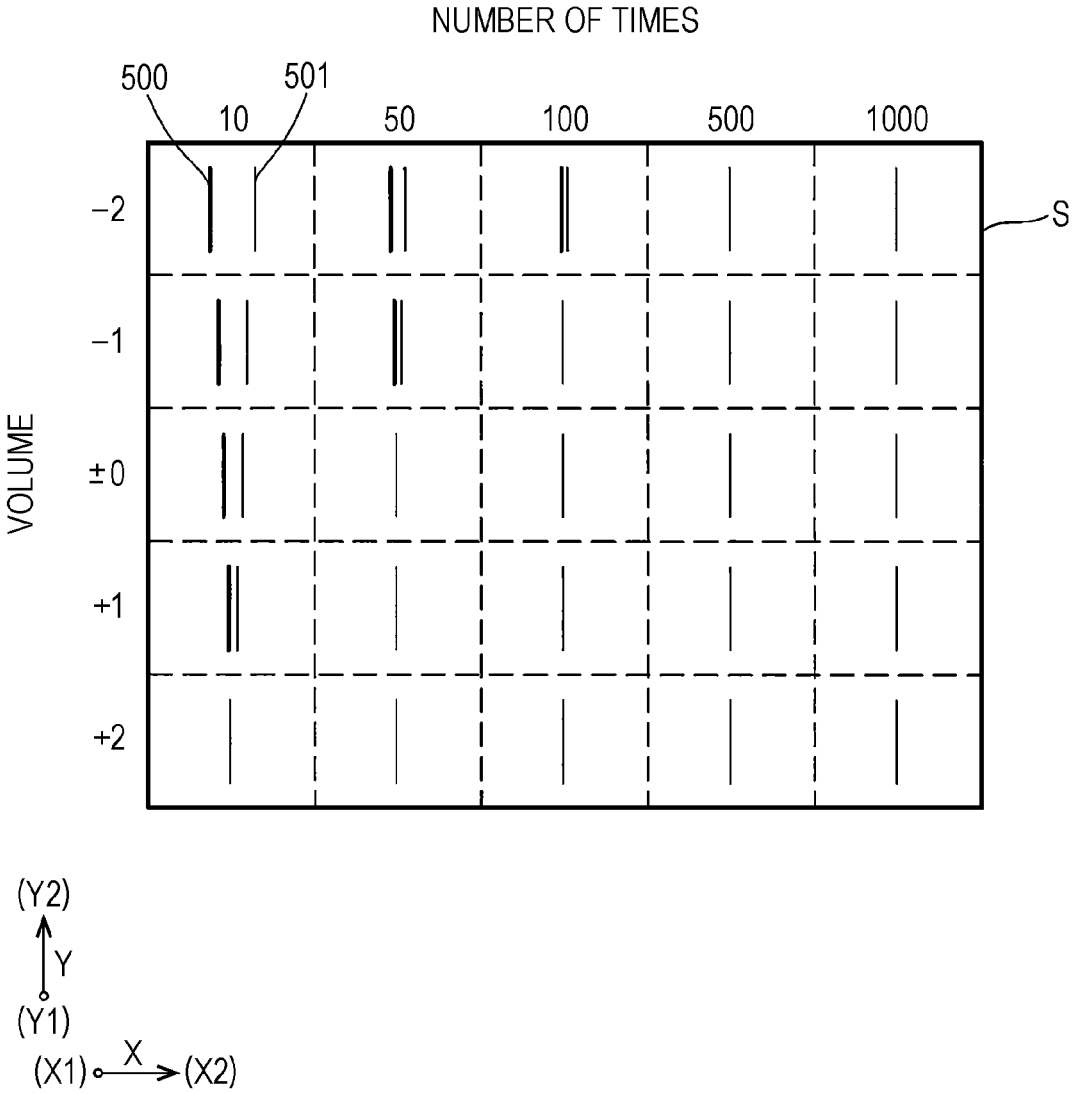
FIG. 13 is a diagram illustrating a test pattern according to Embodiment 2.

FIG. 13 is a diagram illustrating a test pattern of the ink jet recording apparatus according to Embodiment 2 of the invention. The same reference numerals are given to the same members as the embodiment described above and duplicate explanation will be omitted.

In the present embodiment, the flushing controller 211B changes at least one of the conditions 1 to 3 for flushing and outputs a plurality of test patterns, that is, prints the plurality of test patterns in accordance with flushing executed under the changed condition.

Here, printing a test pattern using flushing executed under the changed condition refers to printing a test pattern after executing flushing under the changed condition for a standard test pattern. Although a printing method of a test pattern will be described below in detail, in the present embodiment, a standard test pattern is printed with a non-thickened ink and after thickening ink in the nozzle 21, flushing is performed under the changed condition. After then, a test pattern is printed at the same position with the standard test pattern. Then, a printing position of the standard test pattern and a printing position of the test pattern after flushing under the changed condition are compared with each other. At this time, in a case where a thickened ink is completely discharged by flushing under the changed condition, the printing position of the standard test pattern and the printing position of the test pattern after flushing are the same. On the other hand, in a case where a thickened ink is not completely discharged even by flushing under the changed condition, since a deviation occurs in the trajectory of an ink droplet when printing the test pattern after flushing, the printing position of the standard test pattern and the printing position of the test pattern after flushing are not the same. Therefore, by comparing the printing position of the standard test pattern and the printing position of the test pattern after flushing under the changed condition, it is possible to determine whether or not a thickened ink is reliably discharged by flushing under the changed condition.

In the present embodiment, the condition 1 and the condition 2 among the conditions 1 to 3 for flushing are changed and a plurality of test patterns are printed using flushing under the changed conditions 1 and 2.

That is, since the condition 1 for flushing is the number of times of ejecting ink droplets in one flushing, for example, a plurality of conditions 1 with the number of different times are prepared. In the present embodiment, as different conditions 1, for example, five conditions 1 of 10 times, 50 times, 100 times, 500 times, and 1000 times are prepared. Of course, the embodiment is not limited thereto. For example, if a change quantity (change width) $\Delta t$ and a change range (change number) n (integer) are set as the number of times t which is a standard defining an optimum condition 1 for flushing with a standard ink, it can also be expressed that the number of changed times $t'=t+n\times\Delta t$.

In the same manner, since the condition 2 for flushing is a weight of an ink droplet in flushing, for example, a plurality of conditions 2 with different weights of an ink droplet are prepared. For example, as the plurality of conditions 2, if a change quantity (change width) $\Delta v$ and a change range (change number) m (integer) are set as the potential difference Vh which is a standard defining an optimum condition 2 for flushing with a standard ink, it can also be expressed that the changed potential difference $Vh'=Vh+m\times\Delta v$. In the present embodiment, since four changed potential differences Vh' are formed if the change range m is ±2, as the plurality of different conditions 2, a total of five conditions can be formed together with the potential difference Vh of a standard condition 2.

By combining these five conditions 1 and these five conditions 2, a total of 25 different conditions for flushing can be executed. Therefore, a plurality of test patterns are printed corresponding to the 25 different conditions for flushing. In the present embodiment, a plurality of test patterns are printed in a matrix form onto one recording sheet S. That is, pairs of standard test patterns and test patterns after executing flushing under the changed conditions are disposed in a matrix form. FIG. 13 illustrates an example of the test patterns.

In the present embodiment, as illustrated in FIG. 13, with standard test patterns printed under the conditions 1 and 2 for flushing as a center, test patterns under the changed conditions 1 are printed in the first direction Z which is a horizontal axis and test patterns under the changed conditions 2 are printed in the second direction Y which is a vertical axis to be disposed in a matrix form onto the recording sheet S. Each of directions of the recording sheet S is defined as a direction disposed when printing by the ink jet recording apparatus I, in other words, is defined based on the first direction X, the second direction Y, and the third direction Z of the ink jet recording apparatus I.

Here, a method of printing the plurality of test patterns in a matrix form will be described in more detail. In the present embodiment, for one-pass printing, a plurality of standard test patterns 500 and a plurality of test patterns 501 after flushing under the changed condition 1 are juxtaposed and printed in the first direction X. That is, after the plurality of standard test patterns 500 and the plurality of test patterns 501 after flushing under the changed condition 1 are juxtaposed and printed in the first direction X in first pass, the recording sheet S is transferred in the second direction Y. Then, in second pass, under the condition 2 different from first pass, the plurality of standard test patterns 500 and the plurality of test patterns 501 after flushing under the changed condition 1 are juxtaposed and printed in the first direction X. That is, the condition 2 for flushing is changed every time the paper is transferred.

The standard test pattern 500 is printed after ink in the nozzle 21 of the recording head 1 and in a periphery of the nozzle 21 is refreshed. In the present embodiment, for one-pass printing, the five standard test patterns 500 are juxtaposed and printed in the first direction X.

After the five standard test patterns 500 are printed, ink in the nozzle 21 of the recording head 1 and in a periphery of the nozzle 21 is refreshed again. After then, ink in the nozzle 21 is thickened. As a method of thickening the ink in the nozzle 21, for example, the recording head 1 is run idle in the first direction X for several seconds, that is, is moved in the first direction X without ejecting ink droplets from the recording head 1, so that the ink in the nozzle 21 is thickened. Of course, the method of thickening the ink in the nozzle 21 is not limited thereto. For example, without running idle the recording head 1, the nozzle 21 may be exposed for several seconds in a state in which the recording head 1 is at a home position. Meanwhile, since in the home position, the nozzle 21 is covered with a suction cap of a suction unit (not illustrated), an adhesive cap, or the like and thickening of the ink is suppressed, in order to thicken the ink in the nozzle 21, it is necessary to remove the suction cap and the adhesion cap from the nozzle 21 and to expose the nozzle 21. However, if the recording head 1 is run idle, the ink in the nozzle 21 dries in a short period of time and is likely to become thickened. Therefore, it is preferable to cause the recording head 1 to run idle to thicken the ink in the nozzle 21. Accordingly, the plurality of test patterns can be printed in a short period of time.

After the ink in the nozzle 21 is thickened, without not changing the condition 2, the condition 1 is changed and flushing is executed. After then, the test pattern 501 is printed at the same position as one standard test pattern 500. Refreshing, thickening ink in the nozzle 21, flushing on the changed condition 1, and printing the test pattern 501 are repeated for each of different values of the condition 1. That is, since the condition 1 of the present embodiment has five different values, the five standard test patterns 500 are printed in the first direction X, after then refreshing, thickening an ink, flushing on the changed condition 1, and printing the test pattern 501 are repeated for each of the five standard test patterns 500. Accordingly, test patterns after performing flushing under the five different conditions 1 for each of the five standard test pattern are juxtaposed in the first direction X on the recording sheet S.

By repeatedly printing the standard test pattern 500 and the plurality of test patterns 501 after flushing on the changed condition 1 after the condition 2 is changed, as illustrated in FIG. 13, with the standard test pattern 500 and the plurality of test patterns 501 as a pair, it is possible to dispose pairs of the test patterns 500 and 501 in a matrix form.

Figure 14:
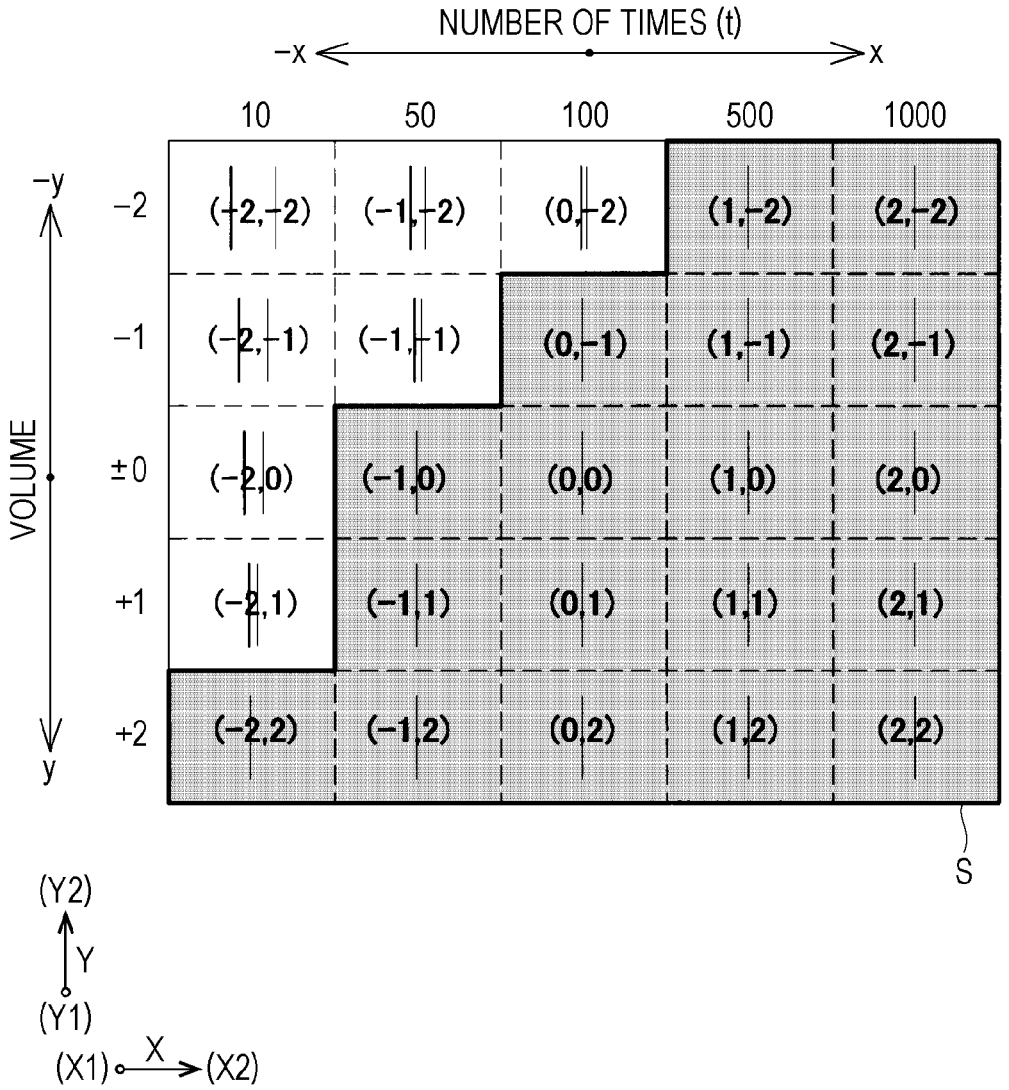
FIG. 14 is a diagram illustrating a test pattern according to Embodiment 2.

As a result, as illustrated in FIG. 14, the test pattern 501 having a printing position deviation with respect to a printing position of the standard test pattern 500 and the test pattern 501 having the same printing position as the standard test pattern 500 are formed. In the present embodiment, regarding a position of the test pattern 501 on the recording sheet S, a horizontal axis represents a range x obtained by changing the number of times t of the condition 1 and a vertical axis represents a weight of an ink droplet of the condition 2. In the present embodiment, the vertical axis represents a range y obtained by changing the potential difference Vh as (x, y). Here, a position at which the number of times t of the condition 1 in the horizontal axis is 100 times is ±0, a position at which the number of times t is 50 times is −1, a position at which the number of times t is 10 times is −2, a position at which the number of times t is 500 times is +1, and a position at which the number of times t is 1000 times is +2. For example, assuming that (0, 0) is a position at which an optimum condition 1 for flushing for a standard ink is ±0 and the condition 2 is 100 times, (1, 0), on one right side of the standard conditions 1 and 2 (0, 0) in the horizontal axis x, is a position at which the condition 1 is ±0 and the condition 2 is 500 times and (−1, 0), on one left side of the standard conditions 1 and 2 (0, 0), is a position at which the condition 1 is ±0 and the condition 2 is 50 times. In the same manner, (0, −1), on one upper side of the standard conditions 1 and 2 (0, 0) in the vertical axis y, is a position at which the condition 1 is −1 and the condition 2 is 100 times and (0, 1), on one lower side of the standard conditions 1 and 2 (0, 0), is a position at which the condition 1 is +1 and the condition 2 is 100 times. In this way, the range x obtained by changing the number of times t of the condition 1 and the range y obtained by changing a weight of an ink droplet (potential difference) Vh of the condition 2 are recognize in association with a position of the test pattern 501. Accordingly, when selecting the test pattern 501 optimum for an ink, it is possible to easily identify the test pattern 501 and to easily recognize the conditions 1 and 2 associated with the identified test pattern 501. In a result illustrated in FIG. 14, among the plurality of test patterns 501, the test patterns 501 of (1, −2) to (2, −2), (0, −1) to (2, −1), (−1, 0) to (2, 0), (−1, 1) to (2, 1), and (−2, 2) to (2, 2) indicate that an ink ejection error does not occur, that is, indicate the conditions 1 and 2 for flushing on which a thickened ink can reliably discharged. As described above, the plurality of test patterns 501 can be easily compared with each other by printing the plurality of test patterns 501 to be disposed in a matrix form. In the present embodiment, by juxtaposing the plurality of test patterns under the changed condition 1 for flushing while moving the recording head 1 in the first direction X which is a direction of movement to the recording sheet S and by juxtaposing a plurality of test patterns under the changed condition 2 for flushing while moving the recording head 1 in the second direction Y which is a paper transfer direction, it is possible to shorten a printing time as compared with juxtaposing the test patterns under the changed condition 2 for flushing in the first direction X. That is, since a driving pulse has to be changed so as to change a weight of an ink droplet Vh which is the condition 2 for flushing and it takes more time to change the driving pulse than to change the number of times t which is the condition 1 for flushing, by juxtaposing the test patterns 501 under the changed condition 2 requiring a long time for changing in the second direction Y, it is possible to shorten the printing time.

Figure 15:
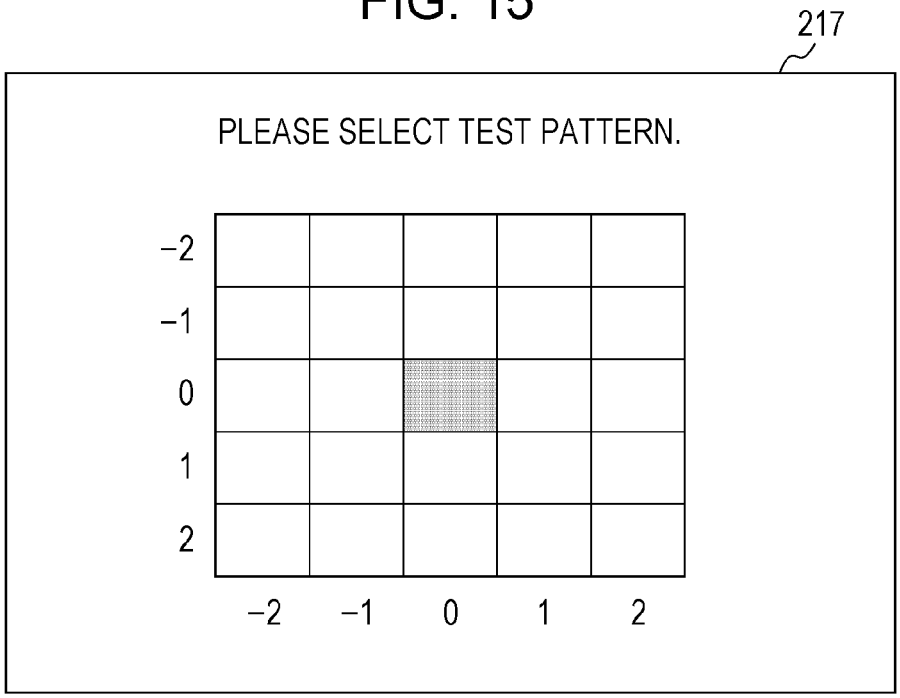
FIG. 15 is a diagram illustrating a selection screen according to Embodiment 2.
Figure 16:
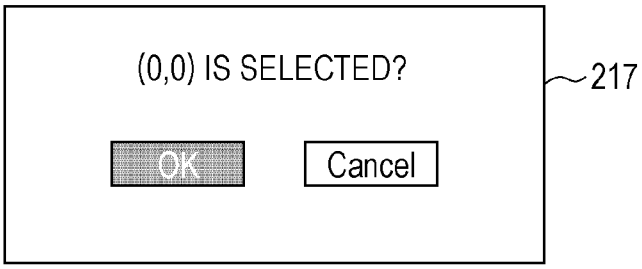
FIG. 16 is a diagram illustrating a selection screen according to Embodiment 2.
Figure 17:
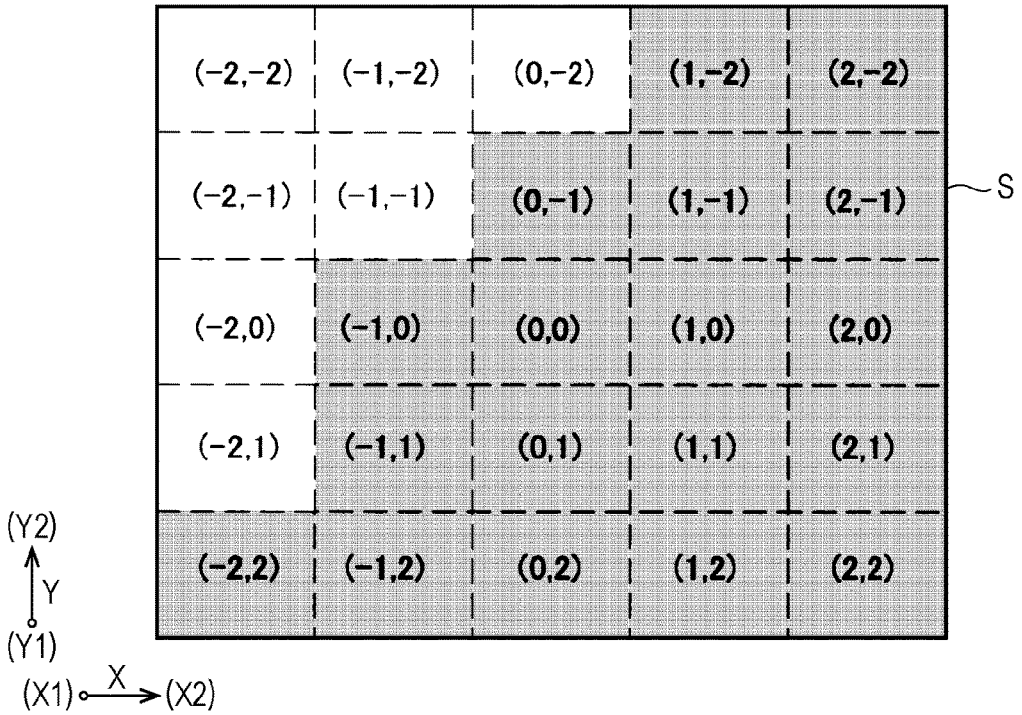
FIG. 17 is a diagram illustrating a test pattern of a standard ink according to Embodiment 2.
Figure 18:
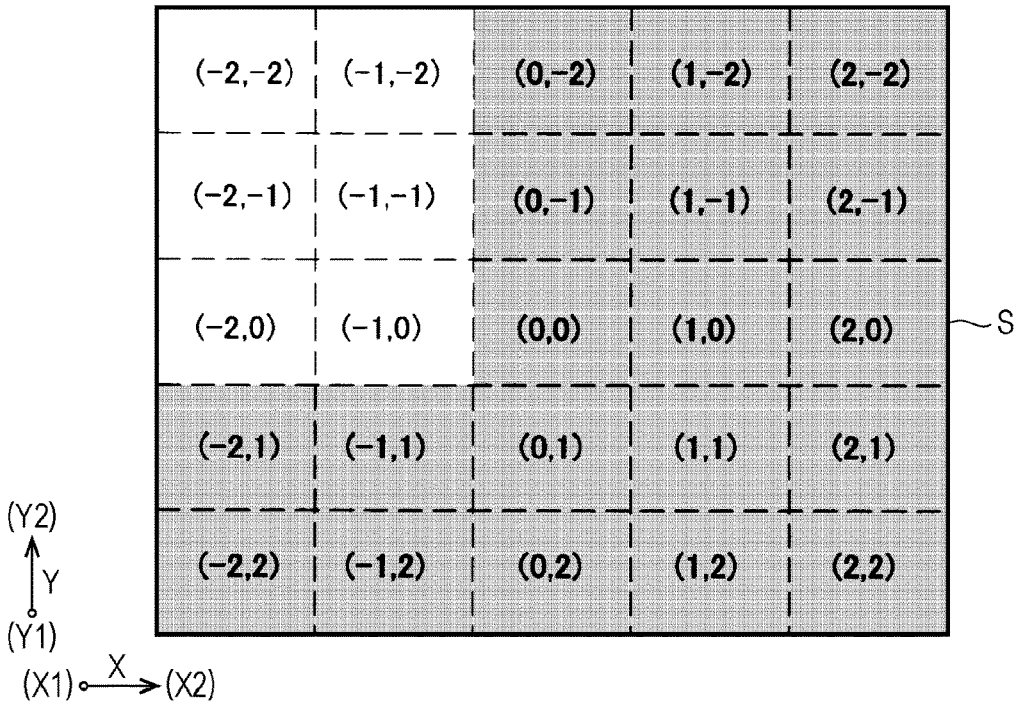
FIG. 18 is a diagram illustrating a test pattern of a standard ink according to Embodiment 2.
Figure 19:
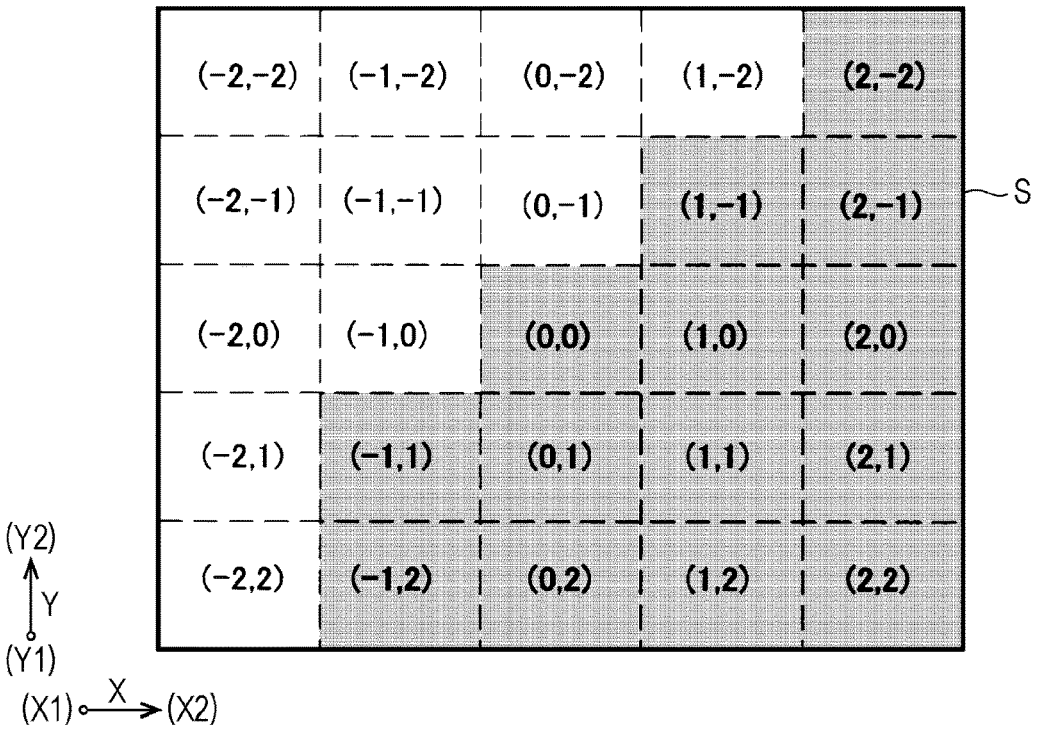
FIG. 19 is a diagram illustrating a test pattern of a standard ink according to Embodiment 2.
Figure 20:
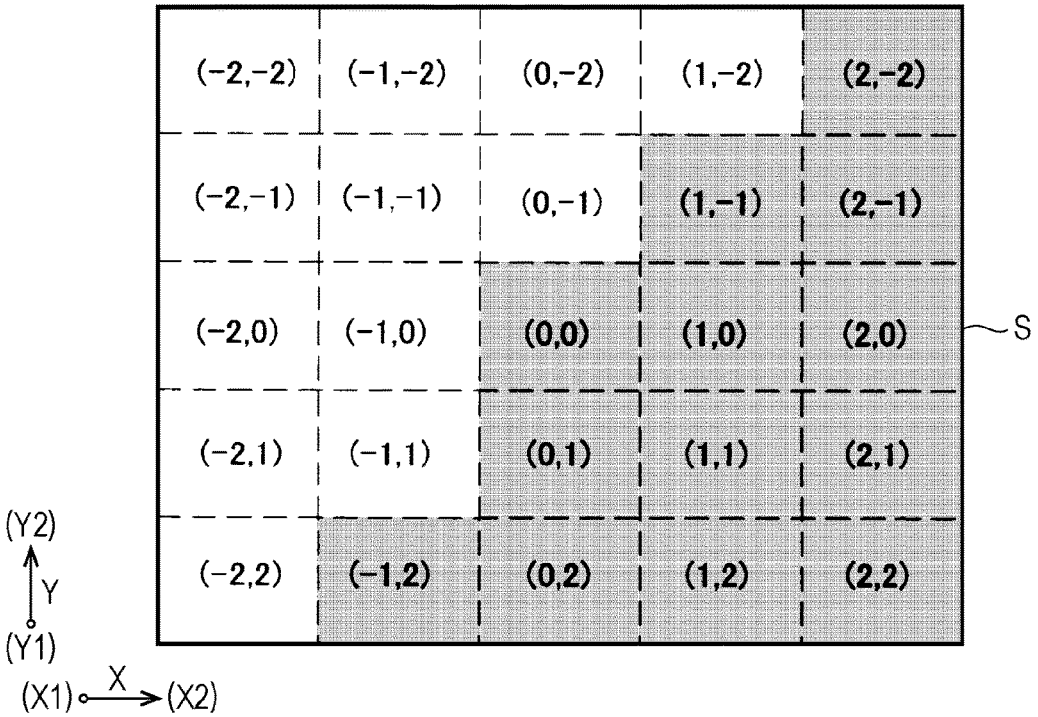
FIG. 20 is a diagram illustrating a test pattern of a standard ink according to Embodiment 2.

A user selects the test pattern 501 which is approximately overlapped with the standard test pattern 500 among an optimum test pattern, that is, the test patterns after flushing under the conditions 1 and 2 from the standard test patterns 500 and the plurality of test patterns 501 printed on the recording sheet S. The selected test pattern 501 is, for example, input from the operation device 218 of the operation panel 216. In the present embodiment, as illustrated in FIG. 15, the presentation unit 211A presents a schematic diagram in which the plurality of test patterns 501 are disposed in a matrix form as blocks, to the display device 217. The operation device 218 selects a block corresponding to the test pattern 501 selected from the blocks presented to the display device 217 based on a printing result of the test pattern 501. If the block corresponding to the test pattern 501 selected by the operation device 218 from the blocks presented to the display device 217 is selected, the presentation unit 211A may present a confirmation screen to the display device 217 as illustrated in FIG. 16. That is, in the confirmation screen illustrated in FIG. 16, when it is confirmed whether the selected test pattern 501 is correct and "OK" is selected, the conditions 1 and 2 associated with the selected test pattern 501 are set. When "Cancel" is selected, the process is returned to the screen of FIG. 15 and the optimum test pattern 501 may be re-selected. Of course, the selection screen presented to the display device 217 is not limited thereto. For example, a position of the selected test pattern may be directly input to (x, y) as a numerical value.

If the optimum test pattern 501 is selected, the flushing controller 211B stores a setting value corresponding to the selected test pattern 501, that is, the conditions 1 and 2 for flushing in the storage unit 212. Otherwise, the flushing controller 211B stores the value as an offset quantity from the standard conditions 1 and 2 in the storage unit 212. The flushing controller 211B controls flushing so as to execute the flushing under the set conditions 1 and 2 even during printing other than the test pattern 501.

Figure 21:
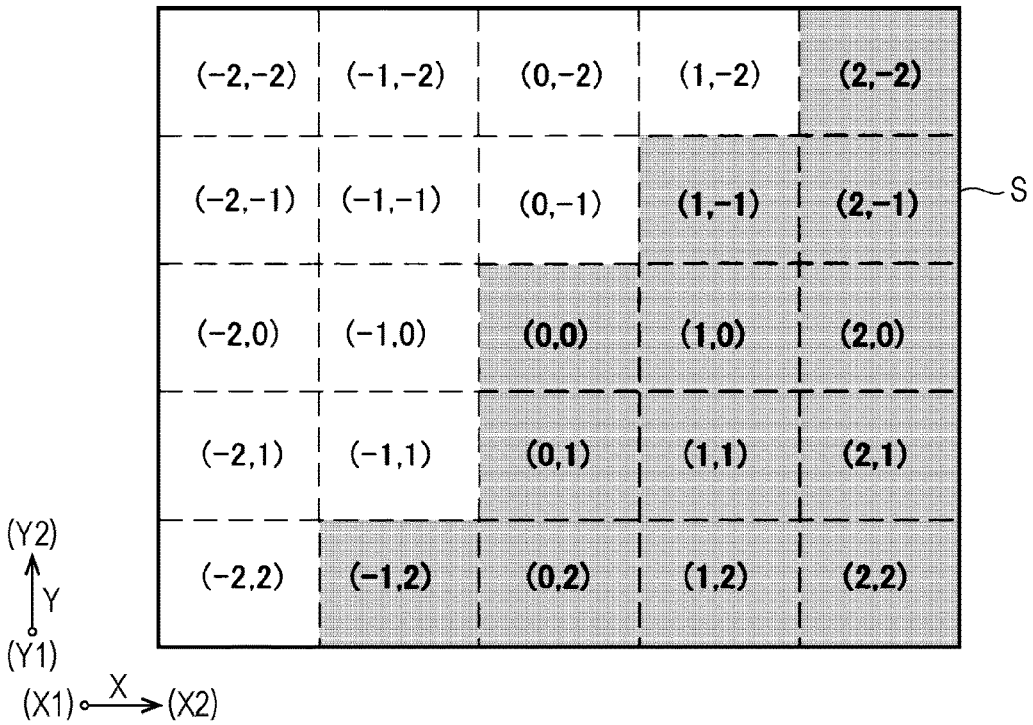
FIG. 21 is a diagram illustrating combined results of a standard ink according to Embodiment 2.
Figure 22:
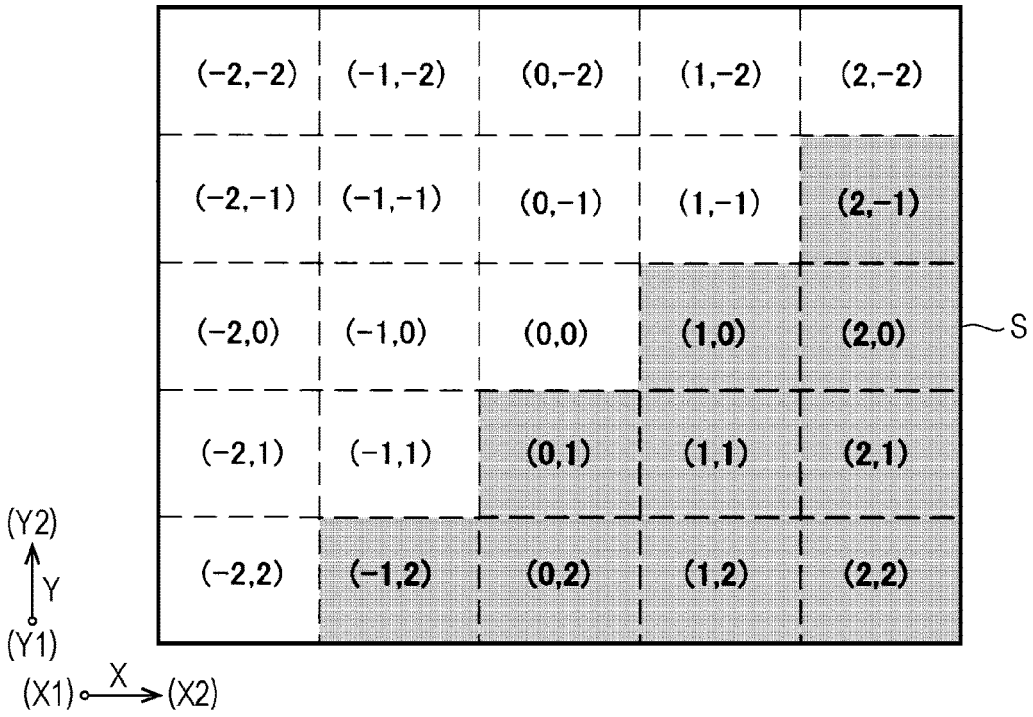
FIG. 22 is a diagram illustrating a test pattern of an ink made by company A according to Embodiment 2.
Figure 23:
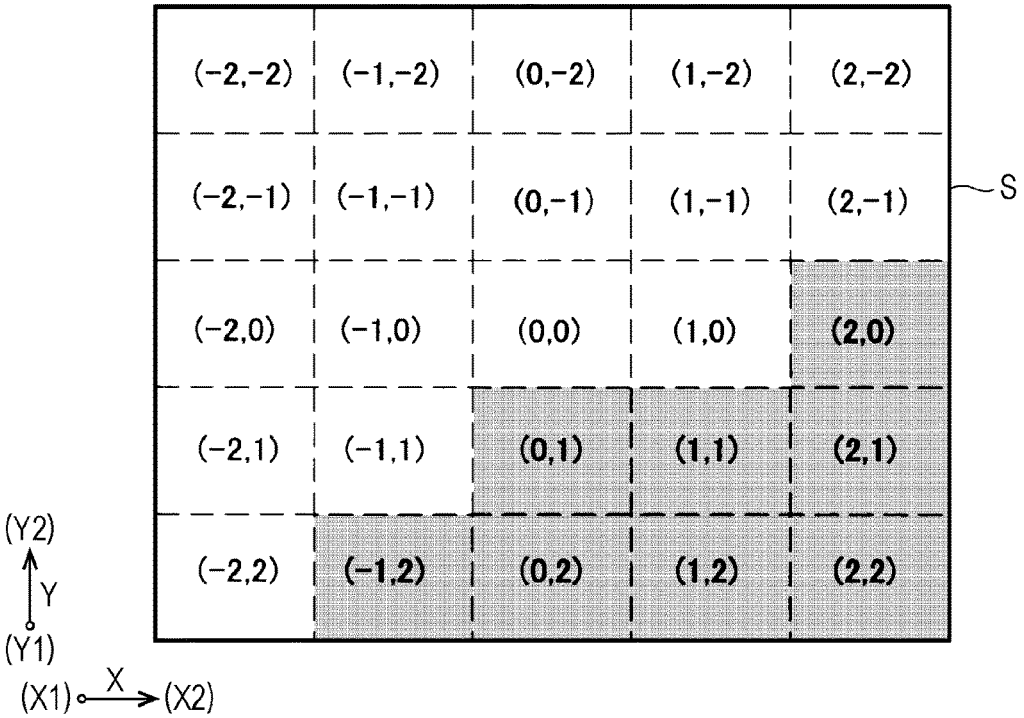
FIG. 23 is a diagram illustrating a test pattern of an ink made by company A according to Embodiment 2.
Figure 24:
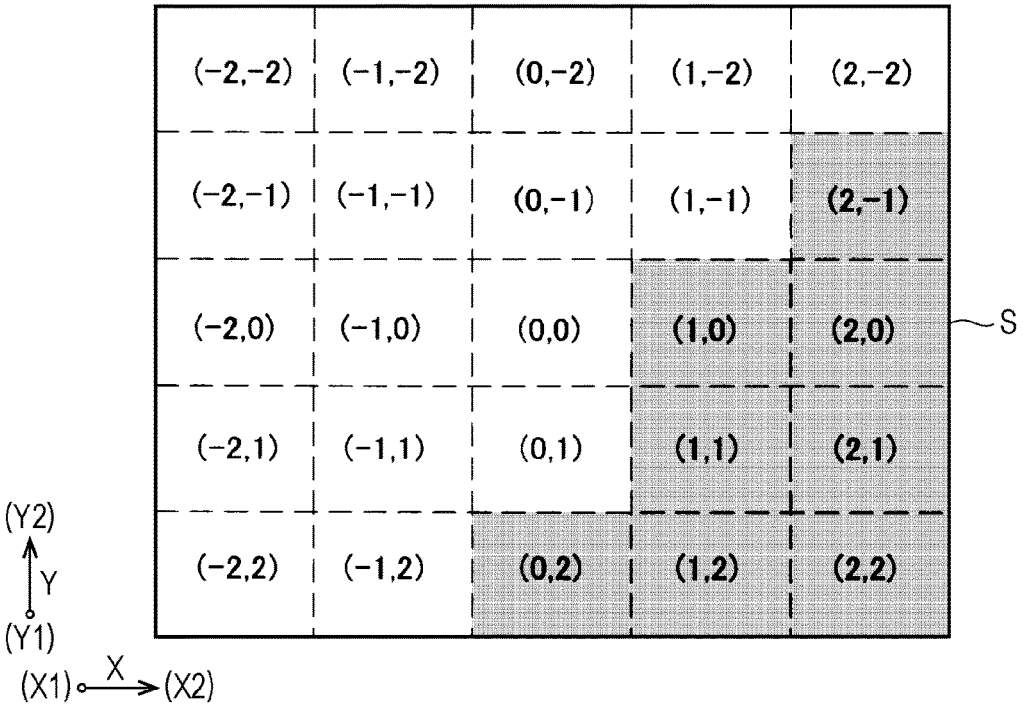
FIG. 24 is a diagram illustrating a test pattern of an ink made by company A according to Embodiment 2.
Figure 25:
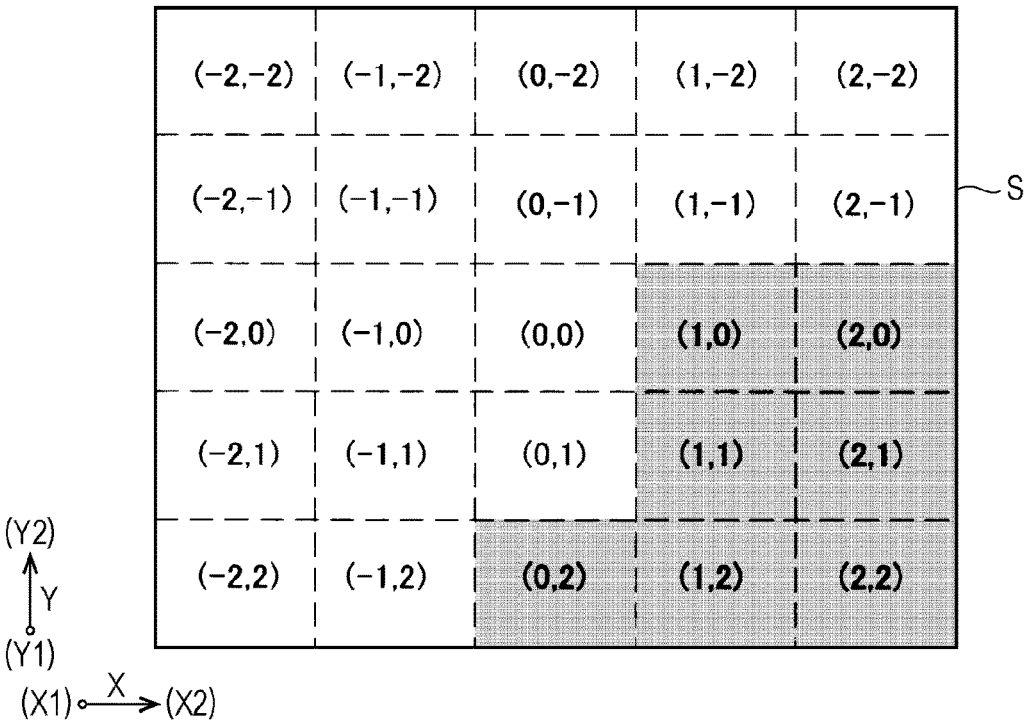
FIG. 25 is a diagram illustrating a test pattern of an ink made by company A according to Embodiment 2.
Figure 26:
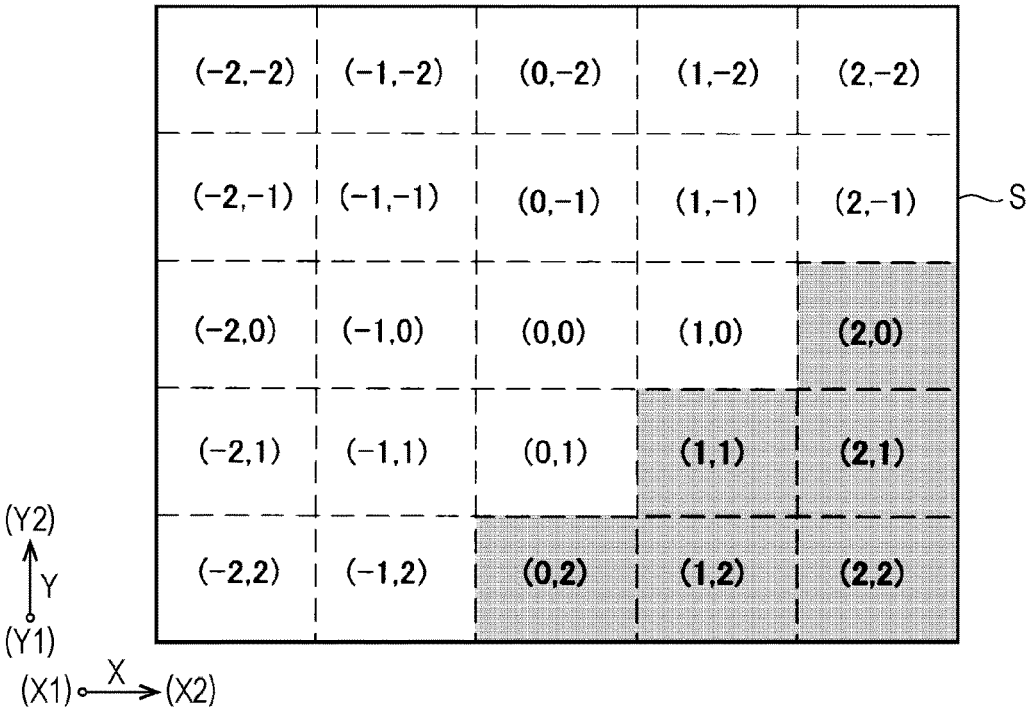
FIG. 26 is a diagram illustrating combined results of an ink made by company A according to Embodiment 2.

Since the ink jet recording apparatus I of the present embodiment ejects inks of four colors, in the flushing adjustment mode, the plurality of test patterns are printed for each of the colors and the test pattern 501 in which an ejection error does not occur for all of the colors is selected. That is, in the present embodiment, printing is performed under the same conditions 1 to 3 for all of colors for flushing without changing the conditions 1 to 3 for flushing for each of the ink colors. For this reason, the plurality of test patterns 501 is printed for each of the ink colors and an optimum test pattern is selected for all of the colors. Here, such examples are illustrated in FIGS. 17 to 26. FIGS. 17 to 20 are test patterns of respective colors in a case of using a standard ink assumed in an initial state, and filled portions indicate portions in which an ejection error does not occur. In addition, FIG. 21 is a diagram illustrating combined results of test patterns for respective colors, that is, positions at which test patterns in which an ejection error does not occur are overlapped with each other. Further, FIGS. 22 to 25 are test patterns for each of colors in a case of using an ink A1 made by company A and FIG. 26 is a diagram illustrating results obtained by combining test patterns of the ink A1 made by company A.

If a test pattern for each of colors in a case of using a standard ink is combined with a test pattern in which an ejection error does not occur as illustrated in FIGS. 17 to 20, a test pattern (0, 0) is a position at which ink consumption is lowest in all of the colors as illustrated in FIG. 21. Therefore, the conditions 1 and 2 of the test pattern (0, 0) are set as standard values in an initial state using a standard ink.

On the other hand, if a test pattern for each of colors in a case of using the ink A1 made by company A is combined with a test pattern in which printing is stably performed as illustrated in FIGS. 22 to 25, a test pattern (1, 1) is a position at which ink consumption is lowest in all of the colors as illustrated in FIG. 26. Therefore, in a case of using the ink A1 made by company A, by using the conditions 1 to 2 for flushing when printing the test pattern (1, 1), it is possible to stably perform printing with all of colors of the ink A1 made by company A by discharging a thickened ink and to suppress unnecessary ink consumption.

Figure 27:
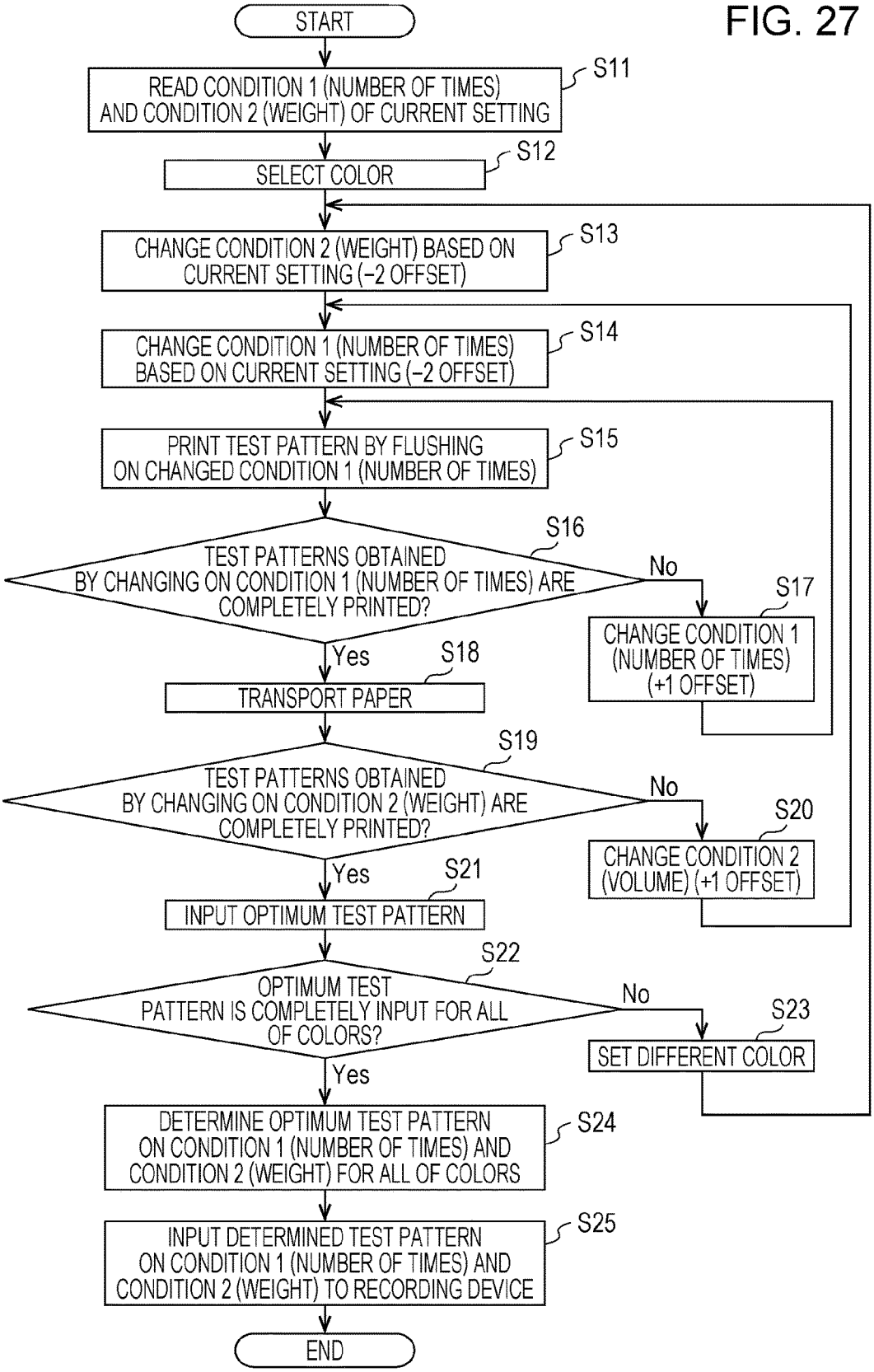
FIG. 27 is a flowchart illustrating an adjusting method according to Embodiment 2.

Here, a flushing adjusting method of the liquid ejecting head will be described with reference to FIG. 27. FIG. 27 is a flowchart illustrating the flushing adjusting method.

As illustrated in FIG. 27, in step S11, initial values of the number of times of the condition 1 for flushing and a weight of an ink droplet of the condition 2 in the flushing adjustment mode are read. Next, in step S12, a color to be printed, in present embodiment, one of cyan (C), magenta (M), yellow (Y), and black (B) is selected. Next, in step S13, with a current setting as a center, the value of a weight of an ink droplet of the condition 2 is changed based on a change quantity and a change range. In the present embodiment, for example, a weight of an ink droplet of the condition 2 is offset by −2 at first. Next, in step S14, the number of times of the condition 1 for flushing is changed based on a change quantity and a change range. In the present embodiment, the number of times of the condition 1 is offset by −2 at first. Next, in step S15, a test pattern using a weight of an ink droplet of the changed condition 2 and the number of times of the changed condition 1 for flushing is printed.

Next, in step S16, it is determined whether or not all of test patterns in a change range of the condition 1 are printed. If it is determined that all of the test patterns in the change range of the condition 1 are not printed in step S16 (No in step S16), the number of times of the condition 1 is changed based on a change quantity and a change range in step S17. In the present embodiment, the number of times of the changed condition 1 is changed to be further offset by +1. That is, the number of times is offset by −1 as compared with the number of times as a standard. Then, steps S15 to S17 are repeated and the plurality of test patterns obtained by changing the condition 1 for the changed condition 2 are printed. In steps S15 to S17, since the plurality of test patterns are printed without transporting the recording sheet S, the plurality of test patterns is juxtaposed in the first direction X which is a direction of movement of the carriage 3.

In addition, if it is determined that all of the test patterns in the change range of the condition 1 are printed in step S16 (Yes in step S16), a transport unit transports the recording sheet S in step S18. Next, in step S19, it is determined whether or not all of test patterns obtained by changing the condition 2 are printed. In a case where it is determined that all of the test patterns obtained by changing the condition 2 are not printed in step S19 (No in step S19), the condition 2 is changed based on a change quantity and a change range in step S20. In the present embodiment, the changed condition 2 is changed to be further offset by +1. That is, the weight of an ink droplet is offset by −1 as compared with a weight of an ink droplet of the condition 2 as a standard.

After then, by repeating steps S15 to S20, all of test patterns obtained by changing the condition 1 for each of the changed conditions 2 are printed.

In a case where it is determined that all of the test patterns obtained by changing the condition 2 are printed in step S19 (Yes in step S19), an optimum test pattern is input in step S21. Next, in step S22, it is determined whether or not optimum test patterns for all of colors are input. If it is determined that the optimum test patterns are not input for all of the colors (No in step S22), different color is set in step S23 and steps S13 to S22 are repeated. That is, in steps S11 to S22, all of test patterns obtained by combining values obtained by changing the condition 1 and values obtained by changing the condition 2 are printed for all of the colors.

Next, if it is determined that the optimum test patterns are input for all of the colors in step S22 (Yes in step S22), the optimum test patterns are determined for all of the colors in step S24. In step S25, the condition 1 and the condition 2 associated with the optimum test patterns for all of the colors are stored in the ink jet recording apparatus I.

As described above, in the present embodiment, since a plurality of test pattern are output using flushing executed under the changed condition, by comparing the plurality of test patterns with each other, it is possible to easily select a specific test pattern. Then, since it is possible to select and to set the changed condition for flushing by selecting the test pattern, it is possible to easily select an optimum condition for flushing in a short period of time as compared with a direct setting of a condition for flushing.

In addition, in the present embodiment, by changing two conditions selected from the conditions 1 to 3 for flushing, the test pattern 501 may be disposed and printed in a matrix form onto the recording sheet S using flushing executed under the changed two conditions. By disposing and printing the plurality of test patterns 501 in a matrix form, it is possible to easily compare the plurality of test patterns 501 with each other.

In the present embodiment, for all of colors, the same conditions 1 and 2 for flushing are performed, but the embodiment is not limited thereto. For example, for each of all of the colors, the different conditions 1 and 2 for flushing may be performed.

Further, in the present embodiment, the plurality of test patterns obtained by changing the conditions 1 and 2 for flushing are printed in a matrix form, but the embodiment is not limited thereto. The plurality of test patterns obtained by changing two conditions selected from the conditions 1 to 3 may be printed in a matrix form. Of course, the plurality of test patterns obtained by changing one condition among the conditions 1 to 3 may be printed. That is, the plurality of test patterns is not limited to be printed in a matrix form.

Other Embodiment

Each of the embodiments of the invention is described above, but a basic configuration of the invention is not limited to thereto.

Figure 28:
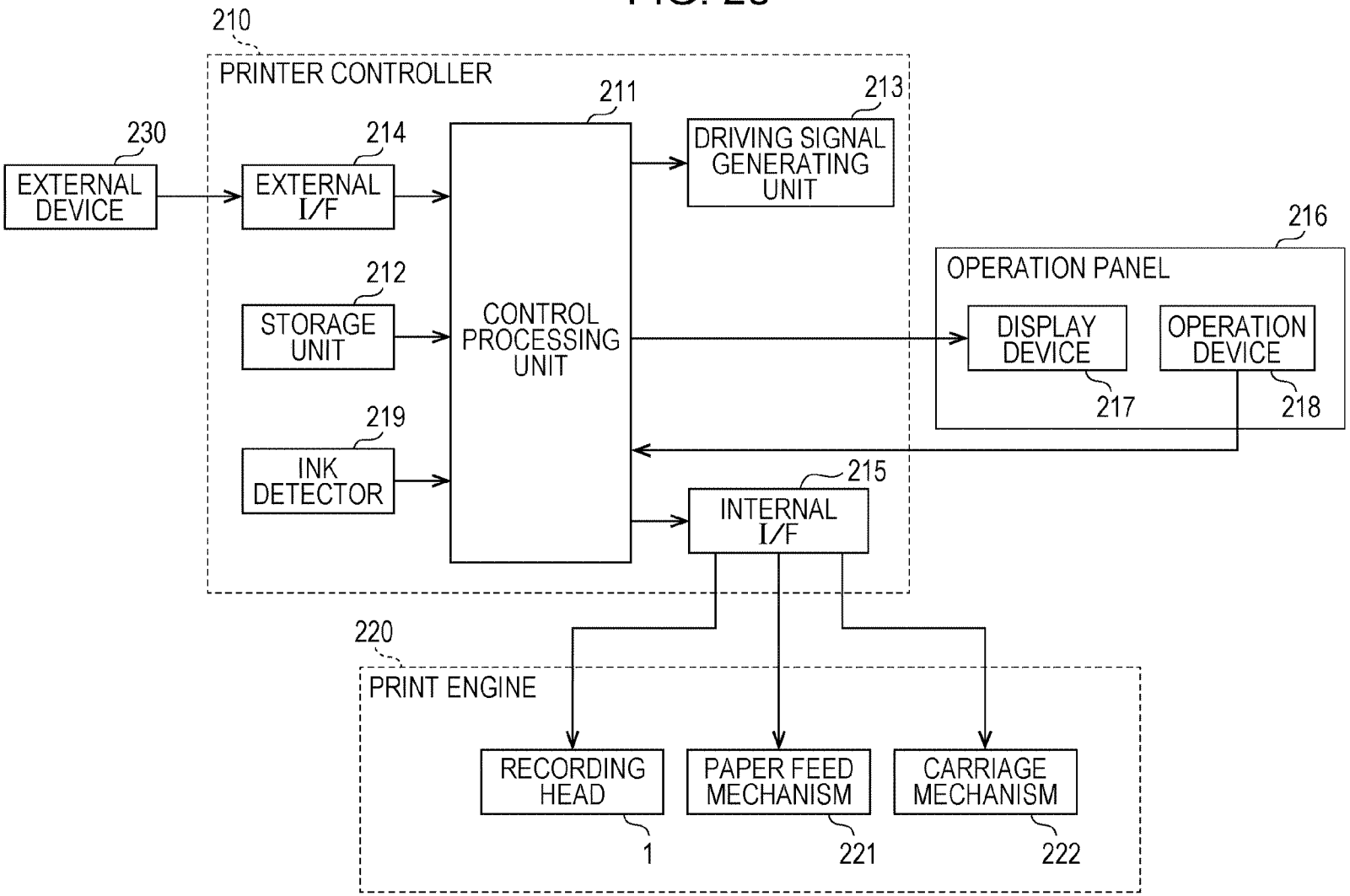
FIG. 28 is a block diagram illustrating an electrical configuration of a recording device according to another embodiment.

For example, in each of the embodiments described above, by a user selecting the flushing adjustment mode of the ink jet recording apparatus I, flushing is started to be adjusted, but the embodiment is not limited thereto. In a case where the ink jet recording apparatus I detects a predetermined status, flushing may be started to be adjusted. In the present embodiment, as illustrated in FIG. 28, the ink jet recording apparatus I has an ink detector 219.

When the ink detector 219 detects that ink other than a standard ink is used, the control processing unit 211 can start to adjust flushing. That is, the control processing unit 211 may present a selection screen indicating whether or not to execute the flushing adjustment mode on the display device 217.

For example, an identification unit such as a two-dimensional code such as a barcode and a QR code (registered trademark) provided in the ink cartridge 2, an IC chip, or the like is attached and based on information read from the identification unit by the ink detector 219, the ink detector 219 may detect that ink other than a standard ink is used.

In addition, there is a case where it is possible to read a remaining ink quantity in the ink cartridge 2 from the identification unit such as the IC chip of the ink cartridge 2. In this case, when based on the remaining ink quantity read from the identification unit such as the IC chip or the like, the ink detector 219 detects replacement or replenishment of an ink, the control processing unit 211 may start to adjust flushing.

Further, for example, after the plurality of test patterns are printed by the flushing adjusting method as described in the embodiment, the presentation unit 211A displays a selection screen, in which a change quantity and a change range of values of the conditions 1 to 3 for flushing can be selected, on the display device 217 and the change quantity and the change range of the conditions 1 to 3 may be changed based on a result selected from the selection screen by a user. Here, an example of the selection screen is illustrated in FIG. 29.

Figure 29:
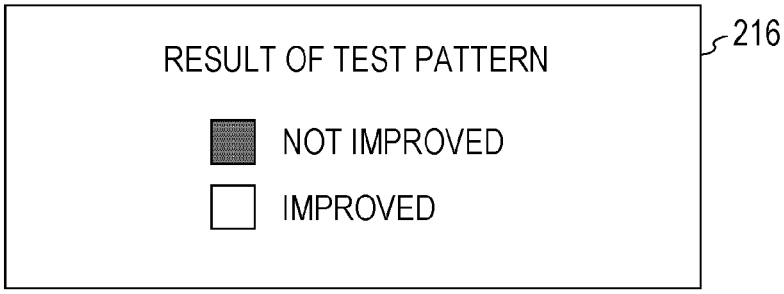
FIG. 29 is a diagram illustrating a selection screen according to another embodiment.

As illustrated in FIG. 29, a selection screen is displayed on the operation panel 216 in a state in which one of "not improved" and "improved" can be selected. "Not improved" is selected when there is no or small number of test patterns stably printed, that is, when printing positions of standard test patterns and printing positions of test patterns after flushing are not equal at all or are hardly equal to each other. If the operation panel 216 selects "not improved", one or both of a change quantity and a change range of the conditions 1 to 3 are increased and the plurality of test patterns are printed again. That is, in a case where "not improved" is selected, the conditions 1 to 3 are modified to be more distant from a standard value than a first test pattern so that a stable test pattern is printed. Accordingly, by printing the stable test pattern, it is possible to set the conditions 1 to 3 to values when the stable test pattern is printed.

In addition, in a case where "improved" is selected, the flushing adjustment mode may be ended. In order to realize further stable printing, one or both of a change quantity and a change range of the conditions 1 to 3 when printing a first test pattern are decreased and the plurality of test patterns are printed again. Accordingly, it is possible to set values for stable printing in detail.

Figure 30:
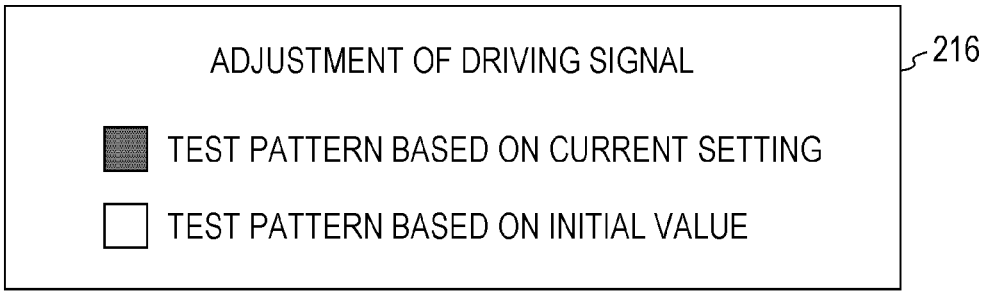
FIG. 30 is a diagram illustrating a selection screen according to another embodiment.

In addition, in a case where flushing is further adjusted by changing ink after the conditions 1 to 3 are set by the flushing adjusting method, as illustrated in FIG. 30, the presentation unit 211A may present whether to print a plurality of test patterns under the conditions 1 to 3 obtained by changing values of the conditions 1 to 3 for a standard ink as standard values or to print a plurality of test pattern under the conditions 1 to 3 obtained by changing current settings as standard values, to the operation panel 216 so that a user can select the test pattern. Meanwhile, in a case where components of ink are similar before and after replacement, it is possible to specify a stable test pattern in a short period of time by changing the current settings as standard values.

Figures 31, 32:
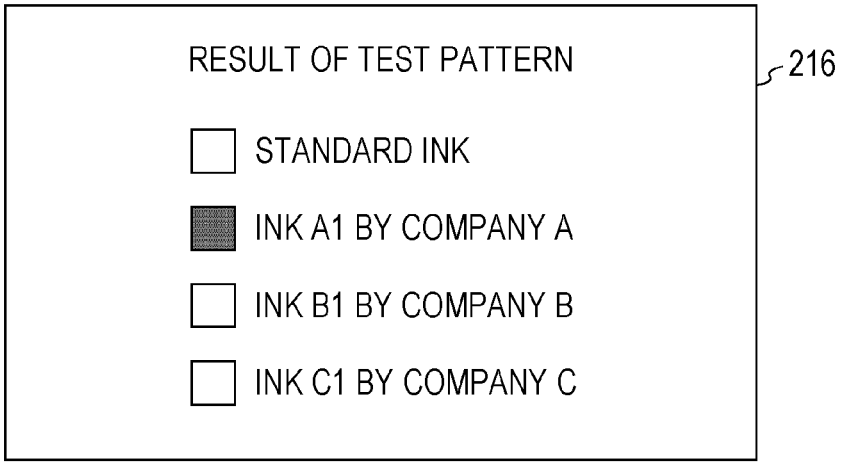
FIG. 31 is a diagram illustrating a correction information table according to another embodiment.
FIG. 32 is a diagram illustrating a selection screen according to another embodiment.

In addition, for each of different inks, in a case where it is possible to investigate the conditions 1 to 3 for flushing suitable for physical properties of the ink in advance by experiment or the like, a type of the ink and a correction value for a standard value of the conditions 1 to 3 corresponding to the type of the ink are stored in advance as a correction information table illustrated in FIG. 31. Then, by causing the presentation unit 211A to present a selection screen of ink illustrated in FIG. 32 on the operation panel 216 so that a user can select the ink, a correction value for the standard values of the conditions 1 and 2 may be set based on the correction information table. Meanwhile, the correction information table illustrated in FIG. 31 is related to the conditions 1 and 2, but the correction information table may be related to the condition 3 in the same manner. The conditions 1 to 3 for flushing corrected based on the correction information table are set as standard values, and the plurality of test patterns may be printed using flushing in which the conditions 1 to 3 are changed with respect to the standard value. On course, by using the correction information table, it is possible to determine optimum conditions 1 to 3 for ink without printing a test pattern. In addition, by specifying an ink, it is possible to correct a change quantity and a change range of the conditions 1 to 3 of the test pattern. For example, if a change quantity of the number of times of the condition 1 for the ink A1 made by company A is 200 times, a change quantity of the number of times of the condition 1 for an ink B1 made by company B is 50 times. By correcting a change quantity of the conditions 1 to 3 using a correction information table by the ink, it is possible to set the conditions 1 to 3 in detail. Therefore, it is possible to reliably discharge a thickened ink while setting a condition for flushing with less ink consumption. In the same manner, a change range of the conditions 1 to 3 may be corrected by the correction information table. In the same manner, for the conditions 2 and 3, a change quantity and a change range may be corrected based on the correction information table.

Further, it is also possible to store past setting values of the conditions 1 to 3 for flushing so that the setting values can be recalled at a desired timing. Accordingly, it possible to return to an arbitrary set value, for example, when setting incorrect.

In addition, in each of the embodiments described above, the selection screen, in which a specific test pattern can be selected from the plurality of test patterns, is displayed on the display device 217, but the embodiment is not limited thereto. The plurality of test patterns may be read by a scanner and a specific test pattern may be selected by image processing.

Further, in Embodiment 1 described above, the carriage 3 is relatively moved to the recording sheet S in the first direction X, the embodiment is not limited thereto. The invention can be applied to a so-called line type recording device which performs printing only by moving the recording sheet S in the second direction Y while fixing the recording head 1 to the device main body 4.

In addition, in each of the embodiments described above, the printer controller 210 realizes a function of adjusting flushing, but the embodiment is not limited thereto. For example, a control program may be read from a non-transitory computer-readable recording medium in which the control program which realizes a flushing adjustment function is stored and executed in the external device 230 such as a host computer. That is, a printer driver or the like of the external device 230 may be configured to adjust flushing. In this case, the external device 230 is a flushing controller which realizes the flushing adjustment function. In addition, in a case where the same ink is used for a plurality of ink jet recording apparatuses I of the same type connected to one external device 230, by adjusting flushing in the external device 230, it is unnecessary to adjust flushing in each of the ink jet recording apparatuses I, and it is possible to adjust flushing for the plurality of ink jet recording apparatuses I at the same time to improve workability.

In addition, in Embodiment 1 described above, a thin film type piezoelectric actuator 300 is used as a driving element for generating a pressure change in the pressure generating chamber 12, the embodiment is not limited thereto. For example, it is preferable to use a thick film type piezoelectric actuator formed by a method such as attaching a green sheet or the like or a longitudinal vibration type piezoelectric actuator which alternately stacks a piezoelectric material and an electrode forming material to be stretched in an axial direction. Further, as the driving element, a device in which a heat generating element is disposed in a pressure generating chamber and droplets are ejected from a nozzle by a bubble generated by heat generation of a heating element, a so-called electrostatic actuator which generates static electricity between a diaphragm and an electrode, deforms diaphragm by electrostatic power, and ejects droplets from the nozzle, or the like can be used.

In addition, in the example described above, in the ink jet recording apparatus I, the ink cartridge 2 which is a liquid storage unit is mounted on the carriage 3, but the example is not limited thereto. For example, The liquid storage unit such as ink tank may be fixed to the device main body 4 and the liquid storage unit and the recording head 1 may be connected via a supply pipe such as a tube. Further, the liquid storage unit may be not mounted on the ink jet recording apparatus.

Further, the invention is applied to a general liquid ejecting apparatus widely including a liquid ejecting head. For example, the invention can be used for the liquid ejecting apparatus using a recording head such as various types of ink jet recording heads used in an image recording device such as a printer, a color material ejecting head used for manufacturing a color filter such as a liquid crystal display, an electrode material ejecting head used for electrode formation such as an organic EL display, a field emission display (FED), a bioorganic material ejecting head used for manufacturing a bio-chip, and the like.

The entire disclosure of Japanese Patent Application No.2016-187577, filed Sep. 26, 2016 is expressly incorporated by reference herein.

What is claimed is:

1. A liquid ejecting apparatus that performs a printing operation in which droplets ejected from a nozzle are deposited onto a medium and a flushing operation in which droplets ejected from the nozzle are not deposited onto the medium to discharge a thickened liquid from within the nozzle, the apparatus comprising:

a recording head configured to eject the droplets from the nozzle;

a presentation unit configured to present on a display device at least one condition from a plurality of conditions and receive a change for a value of the at least one condition, the change being designated by operating an operation device by a user;

a flushing controller configured to control the recording head to perform the flushing operation under the at least one condition of which the value is set based on the change received via the presentation unit, wherein, the plurality of conditions comprises:

a number of times of ejecting droplets from the nozzle in one flushing operation, a weight per one of the droplets from the nozzle in the flushing operation, and a timing of the flushing operation.

2. The liquid ejecting apparatus according to claim 1, wherein the flushing controller is configured to control the recording head to eject the droplets from the nozzle to print a test pattern after performing the flushing operation under the at least one condition of which the value is set based on the change received via the presentation unit.

3. A flushing adjusting method of a liquid ejecting apparatus that performs a printing operation in which droplets ejected form a nozzle are deposited onto a medium and a flushing operation in which droplets ejected from the nozzle are not deposited onto a medium to discharge a thickened from within the nozzle, the method comprising:

printing a first plurality of test patterns including a first test pattern and a second test pattern, the first test pattern being printed after the flushing operation is performed in which a value of a first condition selected from a plurality of conditions is set to a first value, the second test pattern being printed after the flushing operation is performed in which a value of the first condition is set to a second value, the first value and the second value of the first condition being set so that a difference between the first value and the second value is a first change quantity and the first value and the second value are within a first change range;

receiving an instruction through a display device of a specific test pattern selected by user from the first plurality of test patterns; and setting the value of the first condition of the flushing operation based on the instruction on the specific test pattern, wherein, the plurality of conditions comprising:

a number of times of ejecting droplets from the nozzle in one flushing operation, a weight per one of the droplets from the nozzle in the flushing operation, and a timing of the flushing operation.

4. The flushing adjusting method of the liquid ejecting apparatus according to claim 3, the method further comprising:

presenting the first condition on a presentation unit; and receiving a change designated by user for the value of the first condition through the presentation unit, wherein the value of the first condition is set based on the change that is received, and wherein the instruction on the specific test pattern is received through the presentation unit.

5. The flushing adjusting method of the liquid ejecting apparatus according to claim 3, wherein the first plurality of test patterns includes a third test pattern and a fourth test pattern, wherein the first test pattern is printed after the flushing operation is performed in which the value of the first condition is set to the first value and a value of a second condition selected from the plurality of conditions is set to a third value, wherein the second test pattern is printed after the flushing operation is performed in which the value of the first condition is set to the second value and a value of the second condition is set to the third value, wherein the third test pattern is printed after the flushing operation is performed in which a value of the first condition is set to the first value and a value of the second condition is set to a fourth value, wherein the fourth test pattern is printed after the flushing operation is performed in which a value of the first condition is set to the second value and a value of the second condition is set to the fourth value, wherein the first plurality of test patterns is printed in a matrix form, the first test pattern and the second test pattern are printed in a first row in the matrix form, and the third test pattern and the fourth test pattern are printed in a second row in the matrix form, and the first test pattern and the third test pattern are printed in a first column in the matrix form, and the second test pattern and the fourth test pattern are printed in a second column in the matrix form.

6. The flushing adjusting method of the liquid ejecting apparatus according to claim 3, further comprising:

printing a second plurality of test patterns including a fifth test pattern and a sixth test pattern, after the instruction on the specific test pattern is received, the fifth test pattern being printed after the flushing operation is performed in which the value of the first condition is set to a fifth value, the sixth test pattern being printed after the flushing operation is performed in which the value of the first condition is set to a sixth value, the fifth value and the sixth value of the first condition being set so that a difference between the fifth value and the sixth value is a second change quantity and the fifth value and the sixth value are within a second change range.

7. The flushing adjusting method of the liquid ejecting apparatus according to claim 3, the method further comprising:

selecting a liquid ejected from the nozzle; and obtaining the first change quantity from a correction information set in advance in association with the liquid, wherein the first plurality of test patterns includes test pattern that is printed every time the flushing operation is performed in which the value of the first condition is changed base on the first change quantity.

8. The flushing adjusting method of the liquid ejecting apparatus according to claim 3, starting the flushing adjusting method when detecting replacement or replenishment of the liquid ejected from the nozzle.

9. A non-transitory computer-readable recording medium in which a control program is stored, the control program realizing a function of adjusting a flushing operation of a liquid ejecting apparatus that performs a printing operation in which droplets ejected form a nozzle are deposited onto a medium and the flushing operation in which droplets ejected from the nozzle are not deposited onto a medium to discharge a thickened from within the nozzle, the function comprising:

printing a first plurality of test patterns including a first test pattern and a second test pattern, the first test pattern being printed after the flushing operation is performed in which a value of a first condition selected from a plurality of conditions is set to a first value, the second test pattern being printed after the flushing operation is performed in which a value of the first condition is set to a second value, the first value and the second value of the first condition being set so that a difference between the first value and the second value is a first change quantity and the first value and the second value are within a first change range;

receiving an instruction through a display device of a specific test pattern selected by user from the first plurality of test patterns; and setting, the value of the first condition of the flushing operation based on the instruction on the specific test pattern;

wherein, the plurality of conditions comprising:

a number of times of ejecting droplets from the nozzle in one flushing operation, a weight per one of the droplets from the nozzle in the flushing operation, and a timing of the flushing operation.

10. The liquid ejecting apparatus according to claim 1, wherein the presentation unit is configured to present a standard value of the at least one condition associated with a standard liquid.

11. The flushing adjusting method of the liquid ejecting apparatus according to claim 3, wherein the first value a standard value of the first condition associated with a standard liquid.

12. The non-transitory computer-readable recording medium according to claim 9, wherein the first value is a standard value of the first condition associated with a standard liquid.

13. The liquid ejecting apparatus according to claim 1, wherein the presentation unit is configured to present options of the first condition, and to receive one selected by user from the options as the change designated by user.

14. The liquid ejecting apparatus according to claim 1, wherein the presentation unit is configured to receive a value input by user as the change designated by user.

15. The flushing adjusting method according to claim 3, wherein a schematic diagram of the first plurality of test pattern is presented on a presentation unit, wherein the specific test pattern corresponds to a part of the schematic diagram where user selects through the presentation unit.

16. The non-transitory computer-readable recording medium according to claim 9, wherein a schematic diagram of the first plurality of test pattern is presented on a presentation unit, wherein the specific test pattern corresponds to a part of the schematic diagram where user selects through the presentation unit.

* * * * *